US012559882B2

(12) United States Patent
Choi et al.

(10) Patent No.: US 12,559,882 B2
(45) Date of Patent: Feb. 24, 2026

(54) DRYING DEVICE AND METHOD FOR CONTROLLING SAME

(71) Applicant: SAMSUNG ELECTRONICS CO., LTD., Suwon-si (KR)

(72) Inventors: Junhoe Choi, Suwon-si (KR); Jeongsu Han, Suwon-si (KR); Judai Kim, Suwon-si (KR); Taegyoon Noh, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 704 days.

(21) Appl. No.: 18/086,255

(22) Filed: Dec. 21, 2022

(65) Prior Publication Data

US 2023/0121501 A1 Apr. 20, 2023

Related U.S. Application Data

(63) Continuation of application No. PCT/KR2021/006402, filed on May 24, 2021.

(30) Foreign Application Priority Data

Jun. 25, 2020 (KR) ..... 10-2020-0078031

(51) Int. Cl.
*D06F 58/38* (2020.01)
*D06F 34/26* (2020.01)
(Continued)

(52) U.S. Cl.
CPC ..... *D06F 58/38* (2020.02); *D06F 34/26* (2020.02); *D06F 2101/20* (2020.02); *D06F 2105/12* (2020.02); *D06F 2105/46* (2020.02)

(58) Field of Classification Search
CPC ..... D06F 58/38; D06F 34/36; D06F 2105/46; D06F 2105/12; D06F 2101/20
(Continued)

(56) References Cited

U.S. PATENT DOCUMENTS 5,546,678 A * 8/1996 Dhaemers ..... F26B 21/02 34/224
5,899,005 A * 5/1999 Chen ..... D06F 58/38 34/535
(Continued)

FOREIGN PATENT DOCUMENTS

JP 2007-249303 9/2007
JP 2008-124603 5/2008
(Continued)

OTHER PUBLICATIONS

International Search Report, PCT/ISA/210, dated Aug. 27, 2021, issued in PCT Application No. PCT/KR2021/006402.
(Continued)

*Primary Examiner* — Stephen M Gravini
(74) *Attorney, Agent, or Firm* — STAAS & HALSEY LLP

(57) ABSTRACT

The present disclosure provides a drying device and a method for controlling same. The drying device of the present disclosure may comprise: a drum; a driving unit; a heater to heat air supplied to the interior of the drum; a communication interface; and a processor that: when a user command for a drying cycle is received, controls the driving unit so as to rotate the drum in a preset pattern; when data generated on a basis of motion of a sensing device is received through the communication interface from at least one sensing device, identifies a sensing device that has a motion corresponding to the preset pattern among the at least one sensing device; and controls the driving unit and the heater so as to perform a drying cycle on the basis of humidity data received through the communication interface from the identified sensing device.

17 Claims, 17 Drawing Sheets

(51) Int. Cl.
*D06F 101/20* (2020.01)
*D06F 105/12* (2020.01)
*D06F 105/46* (2020.01)

(58) Field of Classification Search
USPC ..... 34/550, 595–610
See application file for complete search history.

(56) References Cited

U.S. PATENT DOCUMENTS

| | | | | |
|---|---|---|---|---|
| 6,079,121 | A * | 6/2000 | Khadkikar | D06F 34/26 34/531 |
| 7,146,749 | B2 * | 12/2006 | Barron | D06F 58/203 34/601 |
| 8,400,276 | B2 | 3/2013 | Tanaka | |
| 8,701,309 | B2 * | 4/2014 | Park | D06F 58/38 236/46 C |
| 9,359,713 | B2 * | 6/2016 | Kang | D06F 33/52 |
| 10,787,762 | B2 | 9/2020 | Choung | |
| 11,368,824 | B2 | 6/2022 | Park | |
| 12,244,249 | B1 * | 3/2025 | Lin | H02P 25/062 |
| 12,320,057 | B2 * | 6/2025 | Du | D06F 58/38 |
| 12,359,364 | B2 * | 7/2025 | Jang | D06F 58/26 |
| 12,398,500 | B2 * | 8/2025 | Lee | D06F 58/24 |
| 2009/0040026 | A1 | 2/2009 | Tanaka | |
| 2011/0203131 | A1 | 8/2011 | Armstrong | |
| 2013/0091728 | A1 | 4/2013 | Morin et al. | |
| 2019/0357023 | A1 | 11/2019 | Park | |
| 2019/0368103 | A1 | 12/2019 | Choung | |
| 2020/0032449 | A1 | 1/2020 | Scheckelhoff et al. | |
| 2023/0121501 | A1 * | 4/2023 | Choi | D06F 58/38 34/550 |
| 2024/0271348 | A1 * | 8/2024 | Seok | D06F 34/06 |
| 2025/0092592 | A1 * | 3/2025 | Park | D06F 34/26 |

FOREIGN PATENT DOCUMENTS

| | | | | |
|---|---|---|---|---|
| JP | 2012-196394 | | 10/2012 | |
| JP | 2013-128632 | | 7/2013 | |
| JP | 2018-143646 | | 9/2018 | |
| KR | 10-1939089 | | 1/2019 | |
| KR | 10-2019-0092329 | | 8/2019 | |
| KR | 10-2019-0134922 | | 12/2019 | |
| KR | 20220000276 | A * | 1/2022 | D06F 58/38 |
| WO | WO-2021261777 | A1 * | 12/2021 | D06F 58/38 |

OTHER PUBLICATIONS

Written Opinion, PCT/ISA/237, dated Aug. 27, 2021, issued in PCT Application No. PCT/KR2021/006402.

Office Action dated Jul. 28, 2025, in Korean Patent Application No. 10-2020-0078031.

* cited by examiner

DRYING DEVICE AND METHOD FOR CONTROLLING SAME

CROSS-REFERENCE TO RELATED APPLICATIONS

This application is a continuation application, under 35 USC 111(a), of International Application PCT/KR2021/006402, filed May 24, 2021, and claims foreign priority to Korean application 10-2020-0078031 filed Jun. 25, 2020, the disclosures of which are incorporated herein by reference in their entireties.

BACKGROUND

1. Field

The disclosure relates to a drying device and a method for controlling the same, and more particularly, to a drying device using a sensing device, and a method for controlling the same.

2. Description of Related Art

A drying device may refer to a device wherein clothes, towels, blankets, etc. (generally referred to as clothes hereinafter) are introduced into the interior of a drum that can rotate, and moisture remaining on the clothes is removed through a drying cycle of supplying hot wind to the interior while rotating the drum.

Meanwhile, a drying cycle may be performed based on the drying degree (or the humidity) of clothes measured through a sensor provided in a drying device. However, the location of a sensor included in a drying device is restrictive such as the inner wall of the door or the inner wall of the drum, etc., and as the drum continuously rotates, the clothes also rotate together, and the sensor is required to physically contact the clothes for measuring the drying degree of the clothes. Accordingly, there are problems that it is impossible to measure the drying degree of the clothes through the sensor, or the accuracy of the drying degree measured through the sensor becomes lower (or an error from the actual drying degree occurs). Accordingly, the drying device performs overdrying, and problems such as contraction of the clothes, or damage to the clothes, or increase of unnecessary power consumption due to increase of the drying time, etc. may occur.

Recently, for resolving such problems, a technology of introducing a sensing device that wirelessly communicates with a drying device into the interior of the drum of the drying device, and controlling the drying device to perform a drying cycle by using the drying degree of the clothes measured through the sensing device is being developed.

In such a case, a technology of saving the power consumption of a sensing device, and a technology for each drying device to recognize a sensing device existing inside the drum in case a plurality of sensing devices or a plurality of drying devices exist, etc. are being required as prerequisites.

SUMMARY

A drying device according to an embodiment of the disclosure may include a drum, a driving unit, a heater to heat air supplied to an interior of the drum, a communication interface, and a processor configured to, based on receiving a user command for a drying cycle, control the driving unit to rotate the drum in a preset pattern, based on receiving data generated on a basis of a motion of a sensing device from at least one sensing device through the communication interface, identify a sensing device having a motion corresponding to the preset pattern among the at least one sensing device, and control the driving unit and the heater to perform the drying cycle based on humidity data received from the identified sensing device through the communication interface.

Meanwhile, the preset pattern may be a pattern having a rotating section in which the drum rotates during a preset first time, and a holding section in which the drum stops during a preset second time, repeatedly performed.

Meanwhile, the processor may identify a sensing device that transmitted data including data matched to the rotating section and data matched to the holding section among the received data as the sensing device having the motion corresponding to the preset pattern.

Meanwhile, the processor may receive identification information of the at least one sensing device from the at least one sensing device through the communication interface, and based on identifying the sensing device having the motion corresponding to the preset pattern among the at least one sensing device, store identification information received from the identified sensing device among the received identification information.

Meanwhile, the processor may, based on receiving humidity data sensed by the at least one sensing device and the identification information of the at least one sensing device through the communication interface, identify humidity data received from the identified sensing device among the received humidity data based on the stored identification information, and control the driving unit and the heater to perform the drying cycle based on the identified humidity data.

Meanwhile, the processor may, based on receiving a user command for the drying cycle, control the driving unit to rotate the drum in the preset pattern, and after the drum rotated in the preset pattern, control the driving unit and the heater to perform the drying cycle according to the user command.

Meanwhile, the processor may receive humidity data from the identified sensing device through the communication interface, and, based on a humidity value of the humidity data received from the identified sensing device being smaller than a reference value, control the driving unit and the heater to stop the drying cycle.

Meanwhile, the processor may receive the data and the humidity data transmitted by a broadcasting method through the communication interface.

The drying device according to an embodiment of the disclosure may further include a sensor to sense humidity of an interior environment of the drum, wherein the processor may, based on a sensing device having a motion corresponding to the preset pattern not being identified after a user command for the drying cycle was received, control the driving unit and the heater to perform the drying cycle based on the humidity sensed by the sensor.

Meanwhile, the received data may include at least one of voltage data generated based on a motion of a sensing device, acceleration data that sensed the motion of the sensing device, and humidity data that sensed humidity of the ambient environment of the sensing device.

Meanwhile, the motion of the sensing device may be motion of the sensing device while the sensing device is inside the drum.

A method for controlling a drying device including a driving unit to control a rotation of a drum and a heater to heat air supplied to an interior of the drum, according to an embodiment of the disclosure, may include the steps of, based on receiving a user command for a drying cycle, rotating the drum in a preset pattern, based on receiving data generated on a basis of a motion of a sensing device from at least one sensing device, identifying a sensing device having a motion corresponding to the preset pattern among the at least one sensing device, and controlling the driving unit and the heater to perform the drying cycle based on humidity data received from the identified sensing device.

Meanwhile, the preset pattern may be a pattern having a rotating section in which the drum rotates during a preset first time, and a holding section in which the drum stops during a preset second time, repeatedly performed.

Meanwhile, in the identifying step, a sensing device that transmitted data including data matched to the rotating section and data matched to the holding section among the received data may be identified as the sensing device having the motion corresponding to the preset pattern.

Meanwhile, the controlling method according to an embodiment of the disclosure may further include the steps of receiving identification information of the at least one sensing device from the at least one sensing device, and based on identifying the sensing device having the motion corresponding to the preset pattern among the at least one sensing device, storing identification information received from the identified sensing device among the received identification information.

Meanwhile, the controlling step may further include the steps of, based on receiving humidity data sensed by the at least one sensing device and the identification information of the at least one sensing device, identifying humidity data received from the identified sensing device among the received humidity data based on the stored identification information, and controlling the driving unit and the heater to perform the drying cycle based on the identified humidity data.

Meanwhile, the motion of the sensing device may be motion of the sensing device while the sensing device is inside the drum.

Meanwhile, in the controlling step, after the drum rotated in the preset pattern, the driving unit and the heater may be controlled to perform the drying cycle according to the user command.

Meanwhile, in the controlling step, based on a humidity value of the humidity data received from the identified sensing device being smaller than a reference value, the driving unit and the heater may be controlled to stop the drying cycle.

Meanwhile, the controlling method according to an embodiment of the disclosure may further include the step of receiving the data and the humidity data transmitted by a broadcasting method.

Meanwhile, the drying device according to an embodiment of the disclosure may further include a sensor sensing humidity for the interior environment of the drum, and the controlling step may further include the step of, based on the sensing device having the motion corresponding to the preset pattern not being identified after a user command for the drying cycle was received, controlling the driving unit and the heater to perform the drying cycle based on the humidity data obtained from the sensor.

Meanwhile, the received data may include at least one of voltage data generated based on a motion of a sensing device, acceleration data that sensed the motion of the sensing device, or humidity data that sensed humidity of the ambient environment of the sensing device.

According to the various embodiments of the disclosure as above, a drying device that identifies a sensing device and uses sensing data of the identified sensing device, and a method for controlling the same can be provided.

A drying device can perform a drying cycle by using more correct sensing data, and prevent contraction of clothes and damage to clothes. Also, a drying device can save power consumption of the drying device.

Additional aspects will be set forth in part in the description which follows and, in part, will be apparent from the description, or may be learned by practice of the presented embodiments.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1A:
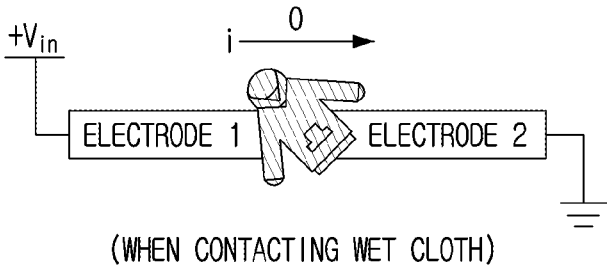
FIG. 1A is a diagram for illustrating a principle of a sensor according to an embodiment of the disclosure.

In describing the disclosure, in case it is determined that detailed explanation of related known functions or features may unnecessarily confuse the gist of the disclosure, the detailed explanation will be omitted. In addition, the embodiments below may be modified in various different forms, and the scope of the technical idea of the disclosure is not limited to the embodiments below. Rather, these embodiments are provided to make the disclosure more sufficient and complete, and to fully convey the technical idea of the disclosure to those skilled in the art.

Also, the various embodiments of the disclosure are not intended to limit the technology described in the disclosure to specific embodiments, but they should be interpreted to include various modifications, equivalents, and/or alternatives of the embodiments of the disclosure. Meanwhile, with respect to the detailed description of the drawings, similar components may be designated by similar reference numerals.

In addition, the expressions "first," "second," and the like used in the disclosure may be used to describe various elements regardless of any order and/or degree of importance. Also, such expressions are used only to distinguish one element from another element, and are not intended to limit the elements.

Further, in the disclosure, the expressions "A or B," "at least one of A and/or B," or "one or more of A and/or B" and the like may include all possible combinations of the listed items. For example, "A or B," "at least one of A and B," or "at least one of A or B" may refer to all of the following cases: (1) including at least one A, (2) including at least one B, or (3) including at least one A and at least one B.

Similarly, as an example, at least one of A, B, and C may refer to all of the following cases: (1) including at least one A, (2) including at least on B, (3) including at least one C, (4) including at least one A and at least one B, (5) including at least one A and at least one C, (6) including at least one B and at least one C, and (7) including at least one A, at least one B, and at least one C.

Also, in the disclosure, singular expressions include plural expressions, unless defined obviously differently in the context. Further, in the disclosure, terms such as "include" and "consist of" should be construed as designating that there are such characteristics, numbers, steps, operations, elements, components, or a combination thereof described in the specification, but not as excluding in advance the existence or possibility of adding one or more of other characteristics, numbers, steps, operations, elements, components, or a combination thereof.

In addition, the description in the disclosure that one element (e.g.: a first element) is "(operatively or communicatively) coupled with/to" or "connected to" another element (e.g.: a second element) should be interpreted to include both the case where the one element is directly coupled to the another element, and the case where the one element is coupled to the another element through still another element (e.g.: a third element). In contrast, the description that one element (e.g.: a first element) is "directly coupled" or "directly connected" to another element (e.g.: a second element) can be interpreted to mean that still another element (e.g.: a third element) does not exist between the one element and the another element.

Further, the expression "configured to" used in the disclosure may be interchangeably used with other expressions such as "suitable for," "having the capacity to," "designed to," "adapted to," "made to," and "capable of," depending on cases. Meanwhile, the term "configured to" does not necessarily mean that a device is "specifically designed to" in terms of hardware. Instead, under some circumstances, the expression "a device configured to" may mean that the device "is capable of" performing an operation together with another device or component. For example, the phrase "a processor configured to perform A, B, and C" may mean a dedicated processor (e.g.: an embedded processor) for performing the corresponding operations, or a generic-purpose processor (e.g.: a CPU or an application processor) that can perform the corresponding operations by executing one or more software programs stored in a memory device.

The disclosure was devised for addressing aforementioned needs, and a purpose of the disclosure is in providing a drying device that identifies a sensing device and uses sensing data of the identified sensing device, and a method for controlling the same.

According to the various embodiments of the disclosure as above, a drying device that identifies a sensing device and uses sensing data of the identified sensing device, and a method for controlling the same can be provided.

According to various embodiments, a drying device can perform a drying cycle by using more correct sensing data, and prevent contraction of clothes and damage to clothes. Also, according to various embodiments, a drying device can save power consumption of the drying device.

Figure 1B:
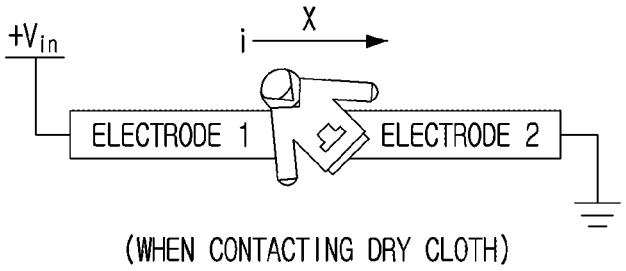
FIG. 1B is a diagram for illustrating a principle of a sensor according to an embodiment of the disclosure.
Figure 1C:
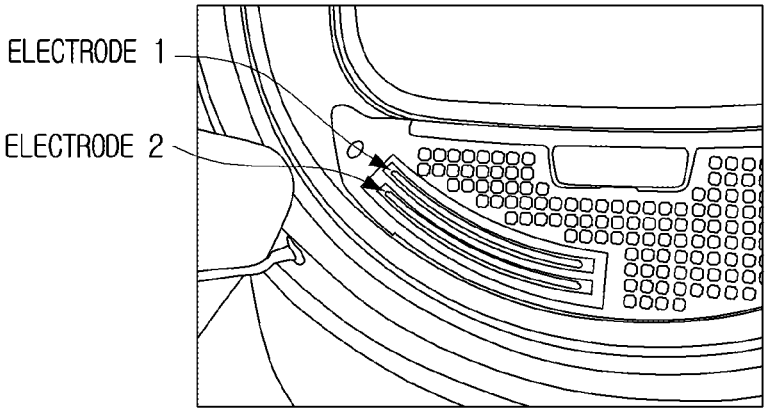
FIG. 1C is a diagram for illustrating an embodiment wherein a sensor is applied to a drying device according to an embodiment of the disclosure.

FIG. 1A and FIG. 1B are diagrams for illustrating a principle of a sensor according to an embodiment of the disclosure. FIG. 1C is a diagram for illustrating an embodiment wherein a humidity sensor is applied to a drying device according to an embodiment of the disclosure.

Referring to FIG. 1A and FIG. 1B, a drying device may include electrode sensors. The electrode sensors may include an electrode 1 and an electrode 2.

In this case, if clothes (a subject to be dried) contacts the electrode 1 and the electrode 2, a current may flow from the electrode 1 to the electrode 2 through the clothes depending on whether the clothes is dry cloth or wet cloth. Here, the wet cloth may refer to a state wherein the clothes contains moisture (a state wherein the clothes is wet), and the dry cloth may refer to a state wherein the clothes does not contain moisture (a state wherein the clothes is dry). For example, in case the clothes is wet cloth as in FIG. 1A, a current may flow between the electrode 1 and the electrode 2 through the clothes that contacted the electrode 1 and the electrode 2. Unlike this, in case the clothes is dry cloth as in FIG. 1B, even if the clothes contacts the electrode 1 and the electrode 2, a current may not flow from the electrode 1 to the electrode 2. By using such a principle, the number of times that a clothes contacts two electrodes provided in the drying device and a current is carried between the two electrodes may be periodically measured, and if the value becomes smaller than or equal to a specific value, it may be determined that the clothes has been dried.

As an example, the drying device may include a drum wherein clothes are accommodated and which can rotate. The drum may be formed of a cylindrical structure which can rotate, and of which interior is empty so as to accommodate clothes. Due to such a structure of the drum, locations of electrodes for which contact with clothes is essentially required may be restricted. For example, as in FIG. 1C, an electrode sensor may be arranged in a specific location of the drying device. Here, FIG. 1C illustrates a scene when viewing the front side (the direction toward the door from the interior of the drum) from the interior of the drum, and the electrode sensor may be arranged on a structure that does not rotate between the drum and the door, so as to contact clothes accommodated inside the drum.

As described above, a drying degree (a degree that clothes are dried or a degree that drying of clothes has been completed) is measured through physical contact between the electrode sensor arranged in a fixed location (a location close to the front side inside the drum) and clothes that rotate together according to the rotation of the drum, and thus the drying degree for some clothes (in particular, clothes located on the rear side inside the drum) accommodated in the drum may not be measured. That is, in case drying of some clothes has not been completed, a problem that it is misjudged that drying has been completed as clothes of which drying has been completed contact the electrode sensor may occur.

For resolving such a problem, the drying device according to an embodiment of the disclosure may perform a drying cycle by using data sensed at a separate sensing device. Here, the sensed data may include humidity data.

Specifically, the sensing device may be introduced into the interior of the drum together with clothes. Then, the sensing device may rotate together with the clothes according to the rotation of the drum. In this case, the sensing device may sense data for determining the drying degree of the clothes, and transmit the data to the drying device through wireless communication. In this case, the drying device may perform a drying cycle by using the received data.

As described above, the drying device uses a sensing device which is not arranged in a fixed location inside the drying device, and thus an error in the drying degree due to change of locations of clothes according to the rotation of the drum can be minimized. Also, the sensing device can easily remove foreign substances adhered to the sensing device (e.g., dust, lint, fiber separated from the clothes, etc.) as it is a device not combined with the drying device (i.e., an independent device that can be separated from the drying device), and thus the accuracy of determination of the drying degree can be maintained.

For this, transmission and receipt of data may be performed through wireless communication between the drying device and the sensing device. For example, the drying device may transmit or receive data with the sensing device introduced into the interior of the drum of the drying device through wireless communication.

Meanwhile, there may not only be a case wherein the sensing device has been introduced into the interior of the drum of the drying device, but also a case wherein the sensing device has not been introduced into the interior of the drum of the drying device.

That is, the sensing device may not be introduced into the interior of the drum of the drying device, but may be located outside the drying device. In such a case, while the drying device performs a drying cycle, the sensing device may obtain data that sensed the outside environment of the drying device. Then, when the sensing device transmits the obtained data to the drying device, the drying device ultimately performs a drying cycle based on the data that sensed the outside environment. Here, the outside environment (e.g.: the humidity, etc.) of the drying device is irrelevant to the interior environment of the drum of the drying device, and thus the drying device may perform a malfunction such as determining that the drying has been completed even when the actual drying of the clothes has not been completed, or determining that the drying has not been completed even when the actual drying of the clothes has been completed.

Also, even in case the sensing device has been introduced into the interior of the drying device, there may be a case wherein the drying device receives data from another sensing device located outside the drying device. That is, while the drying device performs a drying cycle, the drying device may receive sensing data from the sensing device located inside the drum, and another sensing device located outside the drum. In this case, the drying device may also perform a malfunction of the same content as the aforementioned content.

For resolving this, in the disclosure, a drying device that identifies (or recognizes) a sensing device located inside the drying device accurately, and operates based on sensing data received from the sensing device, and a method for controlling the same will be described.

First, a drying device according to an embodiment of the disclosure will be described in more detail with reference to the accompanying drawings.

Figure 2A:
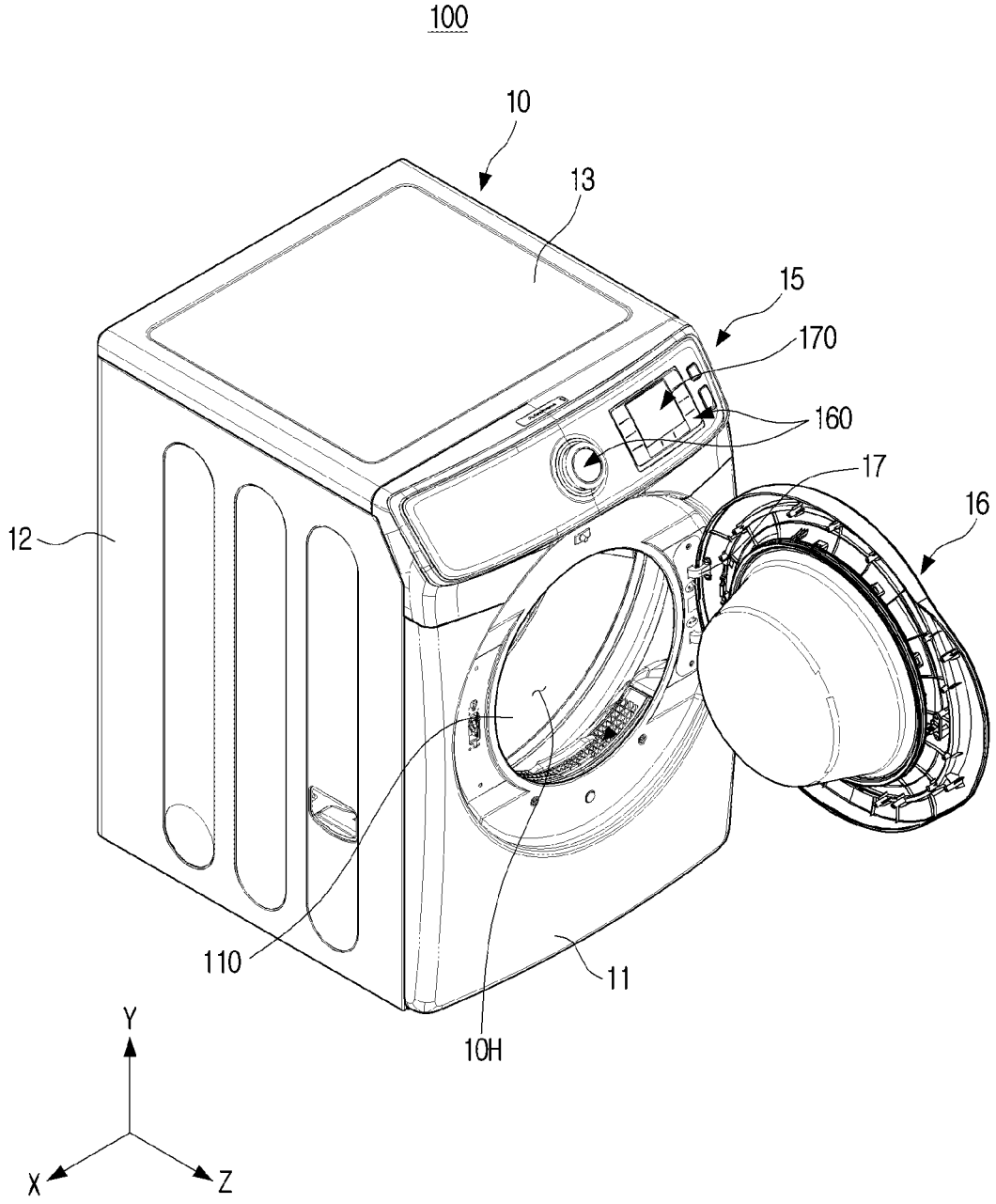
FIG. 2A is a diagram for illustrating a drying device according to an embodiment of the disclosure.
Figure 2B:
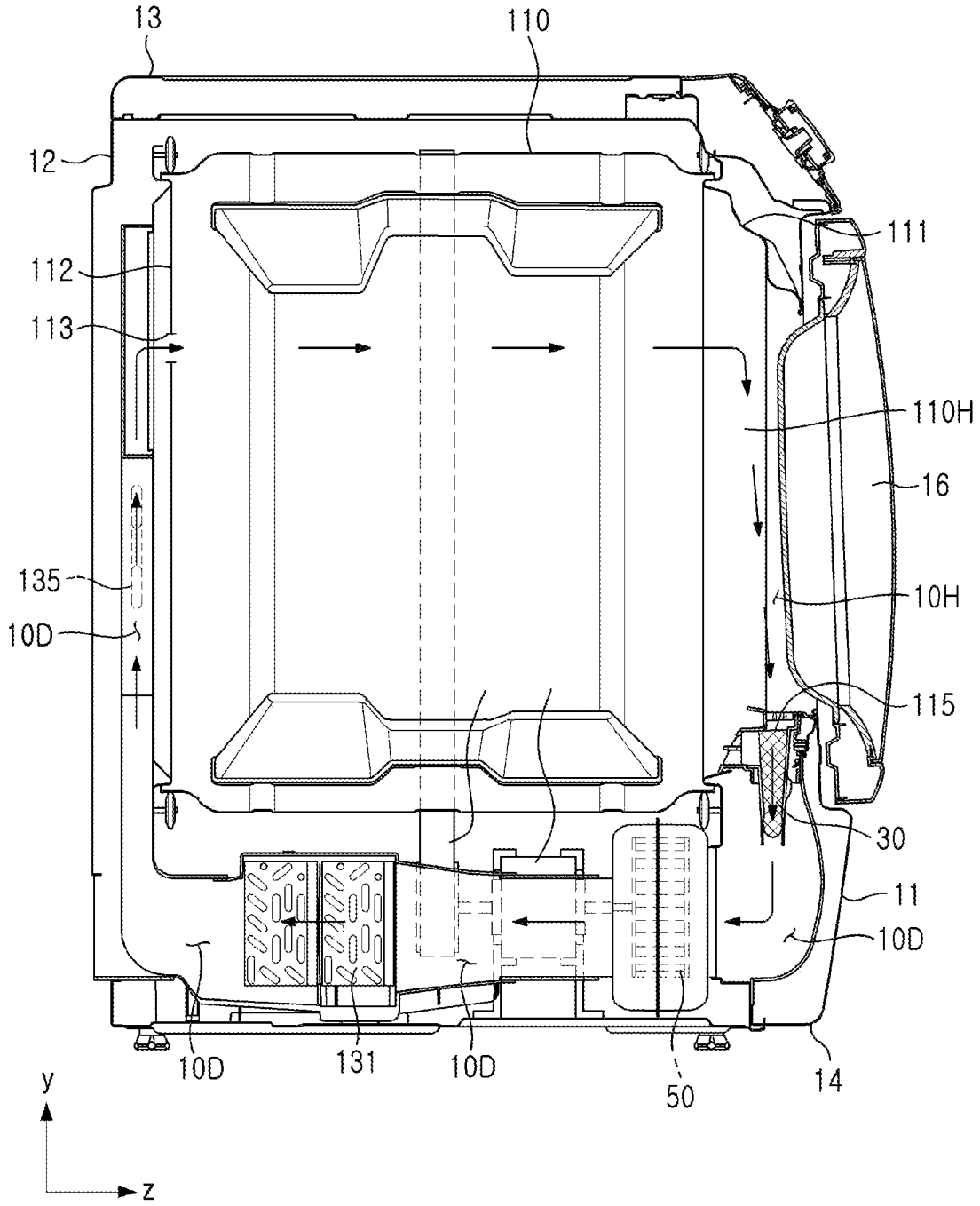
FIG. 2B is a cross-sectional view for illustrating a drying device according to an embodiment of the disclosure.

FIG. 2A is a diagram for illustrating a drying device according to an embodiment of the disclosure. FIG. 2B is a cross-sectional view for illustrating a drying device according to an embodiment of the disclosure.

Referring to FIG. 2A and FIG. 2B, the drying device 100 of the disclosure may include a main body 10 forming the exterior, and a drum 110 arranged inside the main body 10.

The main body 10 may include a front surface cover 11 forming the exterior of the front surface, side/rear surface covers 12 forming the exterior of the side surface and the rear surface, a top cover 13 forming the exterior of the top surface, and a base cover 14 forming the exterior of the lower surface (the bottom surface). However, this is merely an example, and the components may be modified in various forms according to the shape or the structure of the entire exterior of the drying device 100.

On the front surface cover 11, an opening 10H that functions as a passage such that clothes are introduced into the interior of the drum 110 may be formed. The shape of the opening 10H may be a circular form, but is not limited thereto, and it may have various shapes. The opening 10H may be opened or closed by a door 16. For this, the front surface cover 11 may be coupled with the door 16 through a hinge 17. The door 16 may have a shape corresponding to the shape of the opening 10H, and may have a bigger diameter than the opening 10H. Meanwhile, the door 16 may open or close the opening 10H by rotating based on the hinge 17. However, this is merely an example, and the door 16 may open or close the opening 10H through various methods such as moving to one direction (slide moving) among two opposing directions. In this case, the drum 110 of which front surface is opened may also be opened or closed by the door 16.

As an example, a control panel 15 may be arranged on the front surface cover 11. For example, the control panel 15 may be arranged on the upper end or the lower end of the front surface cover 11.

The control panel 15 may include an input interface 160 and an output interface 170. The input interface 160 may receive a user command for controlling the operation of the drying device 100. For this, the input interface 160 may be implemented as a button 161 (refer to FIG. 8) or a touch panel 165 (refer to FIG. 8) of a type that is pushed or touched by a user. Also, this is merely an example, and the input interface 160 may also be implemented as a jog shuttle or a dial of a type that is turned or pushed by a user. The output interface 170 may output various kinds of information with respect to the operation of the drying device 100 or information guiding a user's input. For this, the output interface 170 may be implemented in a form such as a display 171 (refer to FIG. 8) outputting information as a visual image, or a speaker 175 (refer to FIG. 8) outputting information as a voice, etc.

Inside the drum 110, clothes may be accommodated. For this, an opened inlet 110H is formed on the front surface of the drum 110, and the drum 110 may have a structure of which interior is empty. Also, the drum 110 can be driven to rotate. For this, the drum 110 may have a cylindrical structure with a rotation axis at its center. In this case, in the drum 110, the inlet 110H of the drum 110 is arranged toward the opening 10H, and accordingly, the drum 110 may be opened or closed through the door 16. Also, in case the door 16 is opened, clothes may be introduced into the interior of the drum 110. Meanwhile, on the inner wall of the drum 110, a lifter in a protruded form may be formed, and in this case, the lifter may assist with tumbling of the clothes while the drum 110 rotates.

The drum 110 may rotate by a driving force provided from the motor 125. As an example, the drum 110 may be connected with the motor 125 by a belt 126, and the belt 126 may transmit the driving force provided from the motor 125 to the drum 110.

As methods for the drying device 100 to dry clothes, there are a method of supplying heated air to the interior of the drum 110 by using a heat pump 131 (refer to FIG. 8) and removing moisture of the humid air, a method of heating air by using an electric heater 135 (refer to FIG. 8) converting electricity into heat, a method of heating air by using a gas heater generating heat by burning gas, etc. Hereinafter, for the convenience of explanation, explanation will be described based on an example wherein the heat pump 131 is applied to the drying device 100.

Meanwhile, as methods for processing hot and humid air inside the drum 110, there are an air-vent method of discharging hot and humid air to the outside of the drying device 100, and a condensing method of removing moisture in a process of circulating hot and humid air inside the drum 110 inside the drying device 100 and supplying it again to the interior of the drum 110. Hereinafter, for the convenience of explanation, explanation will be described based on an example that the condensing method is applied to the drying device 100.

As an example, on the front surface panel 111 of the drum 110, an outlet 115 functioning as a passage through which air used for drying of clothes is discharged may be formed, and in the outlet 115, a filter 30 collecting foreign substances, etc. separated from the clothes may be installed. On the rear surface panel 112 of the drum 110, an inlet 113 functioning as a passage supplying air to be used for drying of clothes to the interior of the drum 110 may be formed. In a process of a drying cycle, air supplied to the interior of the drum 110 through the inlet 113 may have a state wherein it is relatively hotter and drier than air discharged from the drum 110 through the outlet 115. Accordingly, the inlet 113 through which the relatively hotter air passes may be formed in a relatively higher position than the outlet 115 through which the relatively cooler air passes. However, this is merely an example, and it is possible that the inlet 113 and the outlet 115 can also be changed into forms having various structures.

Also, the drying device 100 may include a fan 50 and a duct 10D. Here, the duct 10D may refer to a passage of air connected with the inlet 113 and the outlet 115. The fan 50 may generate a current (flow) of air. For example, the fan 50 may absorb air passing through the outlet 115, and discharge the air toward the inlet 113. Accordingly, the fan 50 may discharge air inside the drum 110 to the duct 10D, and circulate the air to be supplied to the interior of the drum 110 again.

Meanwhile, the drying device 100 may include a heat pump 131. The heat pump 131 may be arranged on the duct 10D. Also, the heat pump 131 may include a compressor, a condenser, an evaporator, and an expander. The heat pump 131 may make a refrigerant pass through in the order of the compressor, the condenser, the expansion valve, the evaporator, and the compressor.

Here, the compressor may increase the pressure and the temperature by compressing a refrigerant in a gaseous state, and discharge the refrigerant in a gaseous state in a high temperature and high pressure. For example, the compressor may compress a refrigerant through a reciprocating movement of a piston or a rotating movement of a rotor. The refrigerant in a high temperature and high pressure discharged from the compressor may be transmitted to the condenser.

The condenser may condense the refrigerant in a gaseous state compressed at the compressor, and perform phase transition of the refrigerant into a liquid state, and emit heat (latent heat of the refrigerant) to the surroundings through the phase transition. The condenser may heat air through the heat emitted in the condensing process of the refrigerant. The heated air may be supplied to the interior of the drum 110. The refrigerant in a liquid state in a low temperature and low pressure discharged from the condenser may be transmitted to the expander.

The expander may expand the refrigerant in a liquid state condensed at the condenser, and reduce the pressure of the refrigerant. For this, the expander may include a capillary and an electronic expansion valve of which opening rate can vary by an electronic signal, which are for adjusting the pressure of the liquid refrigerant. The refrigerant in a liquid state in a low temperature and low pressure discharged from the expander may be transmitted to the evaporator.

The evaporator may evaporate the refrigerant in a liquid state expanded at the expander, and perform phase transition of the refrigerant to a gaseous state. In this case, the refrigerant in a gaseous state in a low temperature and low pressure discharged from the evaporator may be transmitted to the compressor, and a cycle as above may be repeated. Specifically, the evaporator may absorb heat from the surroundings through the evaporating process of changing the liquid refrigerant in low pressure to a gaseous refrigerant. The evaporator may cool the air passing through the evaporator in the evaporating process. By the evaporator, the surrounding air may be cooled, and when the temperature of the surrounding air becomes lower than the dew point, the air around the evaporator may be coagulated. Water coagulated in the evaporator may be collected by a water basin provided in the lower part of the evaporator. The water collected in the water basin may move to a separate storage, or may be drained to the outside of the drying device 100. Due to coagulation generated around the evaporator, the absolute humidity of the air passing through the evaporator may become lower. That is, the amount of vapor (or moisture) included in the air passing through the evaporator may be reduced.

As described above, in a process of circulating the air inside the drum 110, the drying device 100 may supply dry air to the interior of the drum 110 and evaporate moisture contained in the clothes to vapor (remove moisture contained in the clothes), and remove the vapor included in the air discharged from the interior of the drum 110 by using coagulation around the evaporator, and thereby dry the clothes.

Meanwhile, the drying device 100 may further include an electric heater 135 in the case of using the heat pump 131. In this case, the electric heater 135 may be arranged on the duct 10D, and for example, the electric heater 135 may be arranged on the duct 10D between the heat pump 131 and the inlet 113. In this case, by heating air that passed through the heat pump 131, the electric heater 135 may supply air in a higher temperature than the case of applying only the heat pump 131 to the interior of the drum 110. Also, the electric heater 135 may circulate air more smoothly by making a rising current of air or making air having fast speed through heating. Accordingly, the time spent for drying clothes can be reduced.

Figure 3:
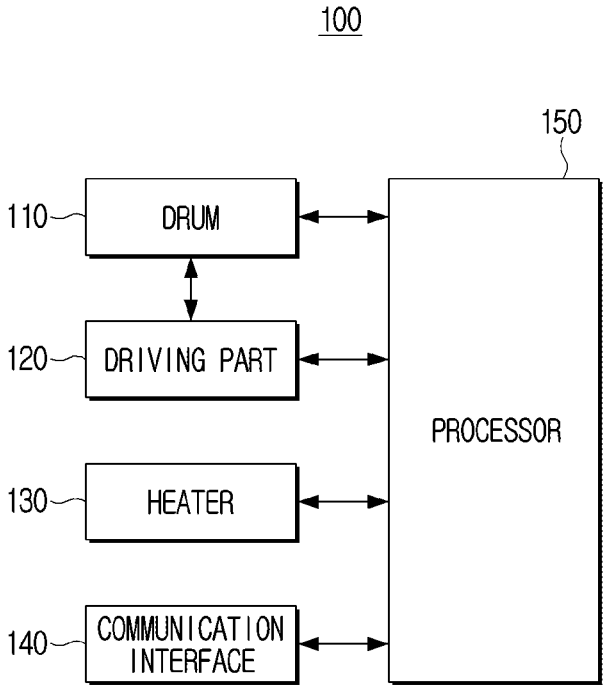
FIG. 3 is a block diagram for illustrating a configuration of a drying device according to an embodiment of the disclosure.

FIG. 3 is a block diagram for illustrating a configuration of a drying device according to an embodiment of the disclosure.

Referring to FIG. 3, the drying device 100 according to an embodiment of the disclosure may include a drum 110, a driving unit 120, a heater 130, a communication interface 140, and a processor 150.

The drum 110 may rotate by a driving force provided from the driving unit 120. Through the inlet 110H of the drum 110, clothes may be introduced into or removed from the interior of the drum 110. Also, the drum 110 may be opened or closed through the door 16.

Also, to the interior of the drum 110, heated air may be supplied, and humid air inside the drum 110 may be discharged to the outside (or the duct 10D of the drying device 100, etc.).

The driving unit 120 may generate a driving force for a rotating movement. For example, the driving unit 120 may generate a driving force according to a control signal of the processor 150. Also, the driving unit 120 may be coupled with the drum 110, and transmit a driving force to the drum 110. Accordingly, the drum 110 may rotate in a specific speed and a specific rotating direction by the driving force transmitted from the driving unit 120. For example, the drum 110 may rotate in a clockwise direction or a counter-clockwise direction based on the rotation axis. For this, the driving unit 120 may include a motor 125 and a belt 126.

The heater 130 may heat air. Air of which temperature has been risen through heating may be supplied to the interior of the drum. For example, the heater 130 may heat air supplied to the interior of the drum 110 according to a control signal of the processor 150.

The communication interface 140 may perform communication with an external device. Specifically, the communication interface 140 may transmit various kinds of data (or information) to an external device according to control by the processor 150, or receive various kinds of data from an external device, and transmit the data to the processor 150. For example, the communication interface 140 may receive data from a sensing device 200 (refer to FIG. 5).

The communication interface 140 may perform communication with an external device according to various kinds of communication methods. In this case, the communication interface 140 may perform communication with the sensing device 200 independent from the drying device 100 according to a wireless communication method. For example, the communication interface 110 may perform communication by using a wireless communication method such as Wi-Fi, Bluetooth, Bluetooth Low Energy (BLE), etc. For this, the communication interface 140 may include at least one of a Wi-Fi module 141 (refer to FIG. 8), a Bluetooth module 143 (refer to FIG. 8), or other communication modules 145 (refer to FIG. 8).

If a user command for a drying cycle is received, the processor 150 may control the driving unit 120 to rotate the drum 110 in a preset pattern. Here, the preset pattern may be a pattern that a rotating section wherein the drum 110 rotates during a preset first time (e.g.: N seconds, N is a number greater than or equal to 0), and a holding section wherein the drum 110 stops during a preset second time (e.g.: M seconds, M is a number greater than or equal to 0) are repeatedly performed. In this case, as in FIG. 5, the drying device 100 may be in a situation wherein the sensing device 200 has been introduced into the interior of the drum 110.

Then, when data generated based on a movement of the sensing device 200 is received from at least one sensing device 200 through the communication interface 140, the processor 150 may identify a sensing device 200 having a motion corresponding to the preset pattern among the at least one sensing device 200 on the basis of the received data. Here, the received data may include at least one of voltage data generated based on a motion of the sensing device 200, acceleration data that sensed the motion of the sensing device 200, or humidity data that sensed humidity of the ambient environment of the sensing device 200.

As an example, the processor 150 may identify a sensing device 200 that transmitted data including data matched to the rotating section and data matched to the holding section among the received data as a sensing device 200 having a motion corresponding to the preset pattern.

As an example, the processor 150 may receive the data and identification information of the at least one sensing device 200 from the at least one sensing device 200 through the communication interface 140, and when a sensing device 200 having a motion corresponding to the preset pattern among the at least one sensing device 200 is identified, the processor 150 may store identification information received from the identified sensing device 200 among the received identification information.

Then, the processor 150 may control the driving unit 120 and the heater 130 to perform a drying cycle based on humidity data received from the identified sensing device 200 through the communication interface 140.

As an example, if a user command for a drying cycle is received, the processor 150 may control the driving unit 120 to rotate the drum 110 in the preset pattern, and after the drum 110 rotated in the preset pattern, control the driving unit 120 and the heater 130 to perform the drying cycle according to the user command.

As an example, in case the identification information of the identified sensing device 200 is stored, when humidity data sensed at the at least one sensing device 200 and the identification information of the at least one sensing device 200 are received through the communication interface 140, the processor 150 may identify humidity data received from the identified sensing device 200 among the received humidity data based on the stored identification information, and control the driving unit 120 and the heater 130 to perform the drying cycle based on the identified humidity data.

As an example, if a humidity value of the humidity data received from the identified sensing device 200 is smaller than a reference value, the processor 150 may control the driving unit 120 and the heater 130 to stop the drying cycle.

As an example, the processor 150 may receive the data and the humidity data transmitted by a broadcasting method through the communication interface 140.

The drying device 100 according to an embodiment of the disclosure may further include a sensor 180 (refer to FIG. 8) sensing humidity for the interior environment of the drum 110. In this case, if a sensing device 200 having a motion corresponding to the preset pattern is not identified after a user command for a drying cycle is received, the processor 150 may control the driving unit 120 and the heater 130 to perform the drying cycle based on the humidity data obtained from the sensor 180.

Hereinafter, explanation regarding more detailed contents will be described with reference to FIG. 4 to FIG. 7.

Figure 4:
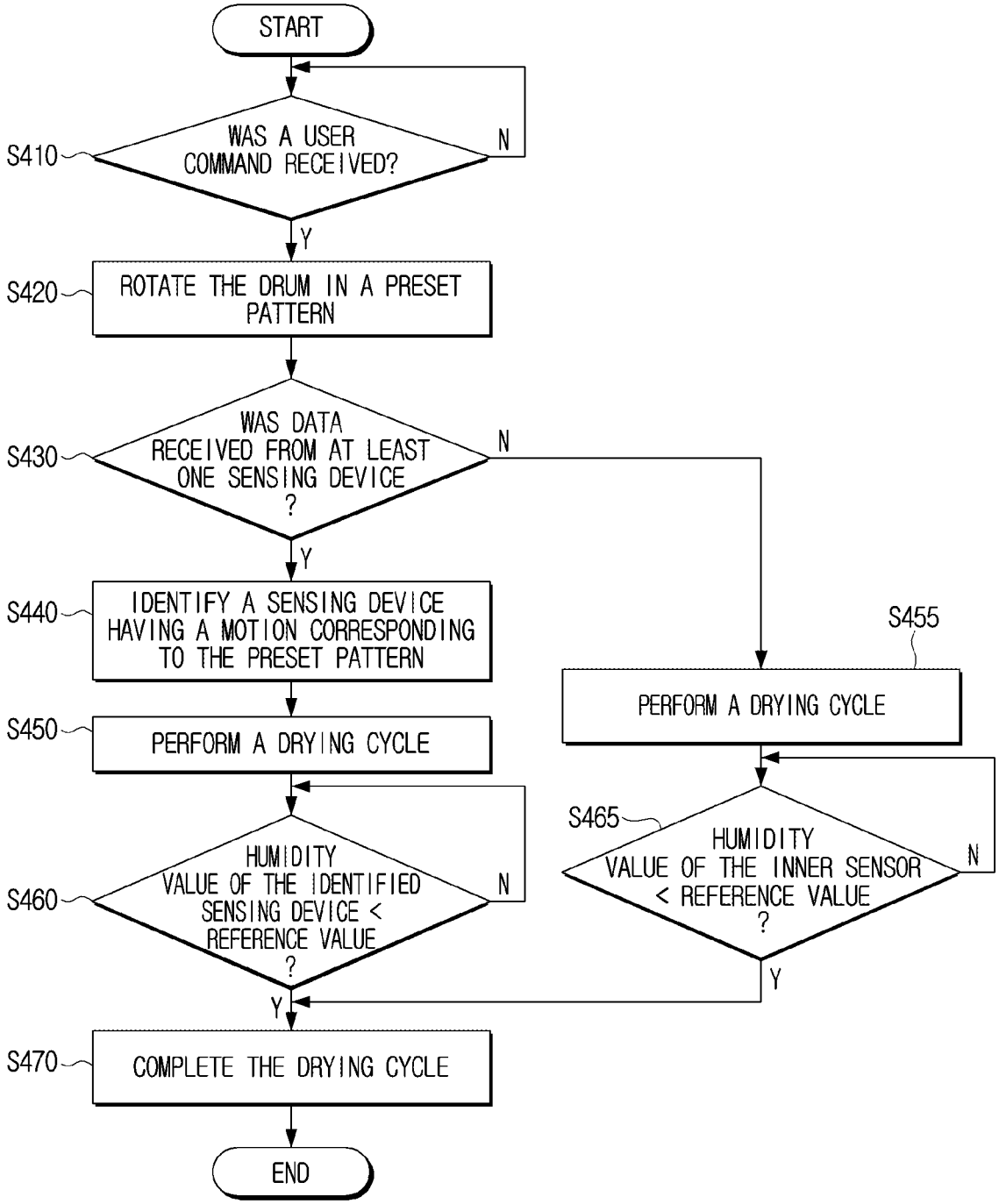
FIG. 4 is a diagram for illustrating an operation of a drying device according to an embodiment of the disclosure.
Figure 5:
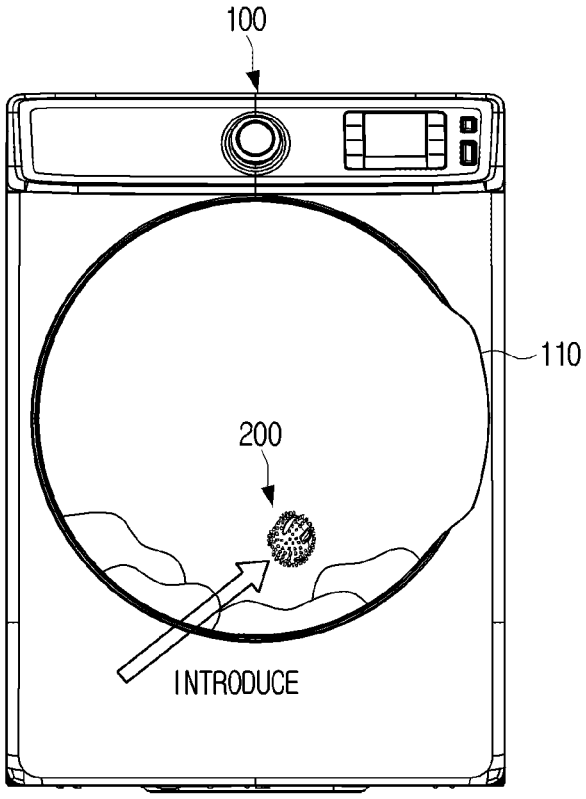
FIG. 5 is a diagram for illustrating a situation wherein a sensing device has been introduced into the interior of a drying device according to an embodiment of the disclosure.
Figure 6:
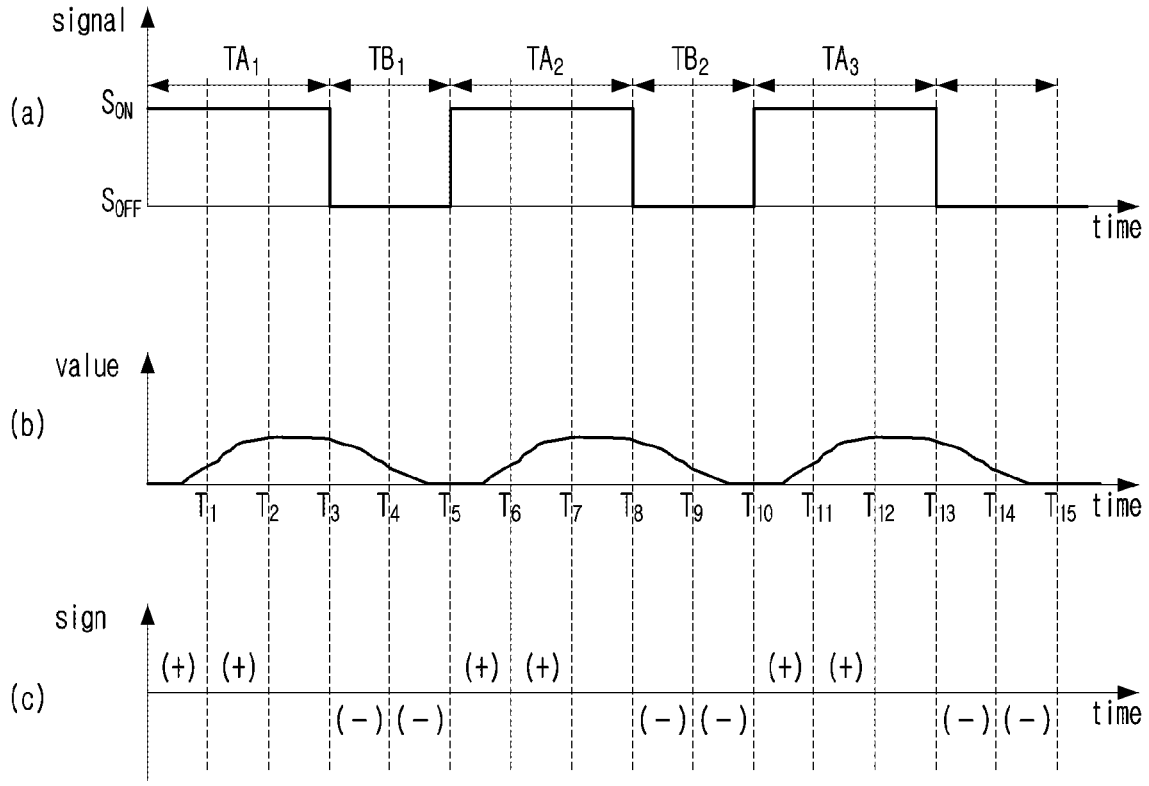
FIG. 6 is a diagram for illustrating a relation between a rotation pattern of a drum and data of a sensing device according to an embodiment of the disclosure.
Figure 7:
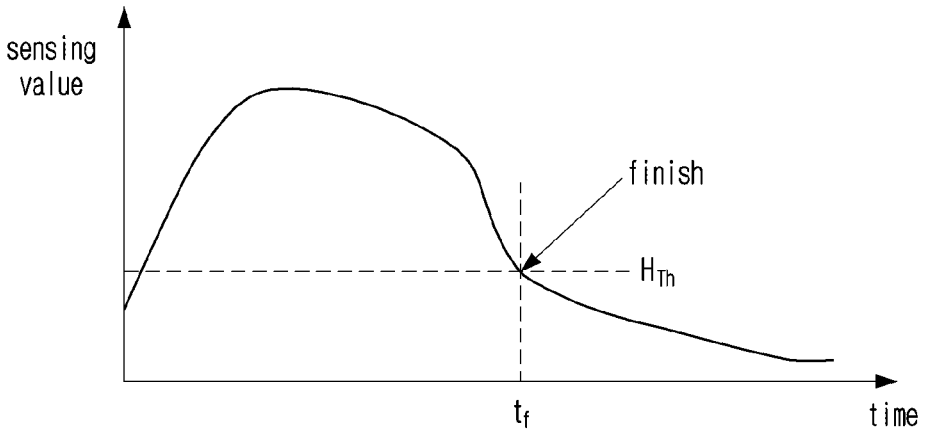
FIG. 7 is a diagram for illustrating a relation between sensing data and a drying cycle according to an embodiment of the disclosure.

FIG. 4 is a diagram for illustrating an operation of a drying device according to an embodiment of the disclosure. FIG. 5 is a diagram for illustrating a situation wherein a sensing device has been introduced into the interior of a drying device according to an embodiment of the disclosure. FIG. 6 is a diagram for illustrating a relation between a rotation pattern of a drum and data of a sensing device according to an embodiment of the disclosure. FIG. 7 is a diagram for illustrating a relation between sensing data and a drying cycle according to an embodiment of the disclosure.

Referring to FIG. 4, if a user command for a drying cycle is received in operation S410, Y, the processor 150 may control the driving unit 120 to rotate the drum 110 in a preset pattern in operation S420. In this case, the sensing device 200 may be in a state of having been introduced into the interior of the drying device 100 (i.e., the interior of the drum 110), as in FIG. 5.

As an example, the user command for the drying cycle may indicate a user command functioning as a trigger for starting the drying cycle. In this case, the drying device 100 may perform the operations from the operation S410 to the operation S470 through one user command. That is, if a user command for a drying cycle is received, the drying device 100 may perform the operation of identifying the sensing device 200 from the operation S410 to the operation S440, and perform the drying cycle from the operation S450 to the operation S470.

As another example, the user command for the drying cycle may indicate a user command functioning as a trigger for performing an operation of initially identifying (or recognizing) the sensing device 200. In this case, if a user command for identifying the sensing device 200 is received, the drying device 100 may perform the operation of identifying the sensing device 200 from the operation S410 to the operation S440. Afterwards, when a separate user command (a user command for starting the drying cycle) is received, the drying device 100 may perform the drying cycle from the operation S450 to the operation S470.

Meanwhile, a user command for a drying cycle may be received through the input interface 160 (refer to FIG. 8) provided in the drying device 100, or received from an external device (e.g., a smartphone, etc.) through the communication interface 140. Here, the user command may be received in various forms such as a form of pushing the button 161 (refer to FIG. 8), a form of touching the touch panel 165 (refer to FIG. 8), a form wherein the user utters a specific voice command, etc.

Meanwhile, the preset pattern may be a pattern that a rotating section wherein the drum 110 rotates during a preset first time and a holding section wherein the drum 110 stops during a preset second time are repeatedly performed. This is for identifying the sensing device 200 wherein a motion occurs according to the rotation of the drum 110. Here, the identified sensing device 200 may be regarded as being located inside the drum 110.

For example, referring to (a) of FIG. 6, the preset pattern may include a rotating section $TA_1$, a holding section $TB_1$, a rotating section $TA_2$, a holding section $TB_2$, and a rotating section $TA_3$. As described above, the processor 150 may transmit a control signal $S_{on}$ or a control signal $S_{off}$ to the driving unit 120 according to time. In this case, the driving unit 120 may rotate the drum 110 by transmitting a driving force to the drum 110 according to the control signal $S_{on}$. Also, the driving unit 120 may stop the rotation of the drum 110 by not transmitting the driving force according to the control signal $S_{off}$. Meanwhile, (a) of FIG. 6 is merely an example, and the number of times that a rotating section and a holding section are repeated, and the time of each of the rotating section and the holding section may be implemented while being modified in various ways.

Figure 8:
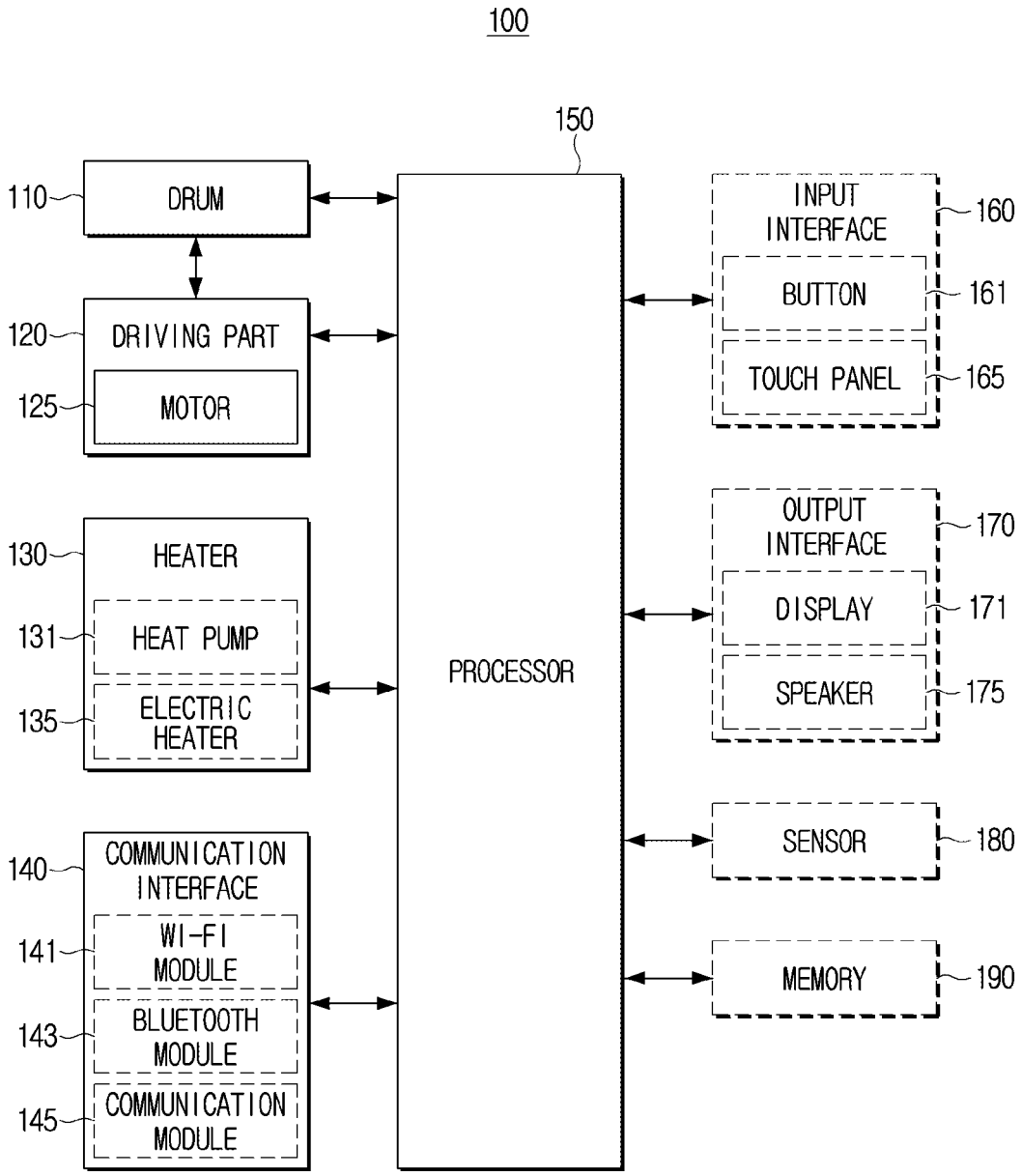
FIG. 8 is a block diagram for illustrating additional components of a drying device according to an embodiment of the disclosure.

Meanwhile, the present pattern is a unique pattern granted to each drying device 100, and it may be stored in the memory 190 (refer to FIG. 8). For example, the preset pattern may include information on the time (or period) of a rotating section and a holding section, and the number of times that the rotating section and the holding section are repeated. Alternatively, the preset pattern may be a pattern generated randomly by the processor 150.

Then, when data generated based on a motion of the sensing device 200 is received from at least one sensing device 200 through the communication interface 140 in operation S430, Y, the processor 150 may identify a sensing device 200 having a motion corresponding to the preset pattern among the at least one sensing device 200 on the basis of the received data in operation S440.

Specifically, the processor 150 may receive data generated based on the motion of the sensing device 200 from at least one sensing device 200 through the communication interface 140 in operation S430, Y.

Here, the processor 150 may receive the data and the humidity data transmitted by a broadcasting method through the communication interface 140. That is, the sensing device 200 may transmit various kinds of data by a broadcasting method. Here, the broadcasting method is a method of transmitting a wireless signal including data without a specific target. For example, in case the sensing device 200 uses a broadcasting method of Bluetooth Low Energy (BLE), the sensing device 200 may transmit a packet signal by including the data of the sensing device 200 in the packet signal in a broadcast mode (or an advertise mode).

In this case, at least one electronic device (e.g.: the drying device 100, etc.) located around the sensing device 200 (i.e., located in a distance wherein a signal can be received from the sensing device 200) may receive data transmitted from the sensing device 200 without a separate connection or paring process with the sensing device 200. That is, broadcasting is a method of transmitting data from one sensing device 200 to one or more other electronic devices, and a signal (or data) by the broadcasting method is transmitted to one direction. Like this, in the broadcasting method, an electronic device gives a signal requesting connection to another electronic device, and the electronic device receives a signal accepting connection from another external device as a response thereto, and thus a process wherein the electronic device and another external device are connected with each other, or a process wherein their connection is maintained (i.e., paring through transmission and receipt of signals in both directions) is not required, and accordingly, power consumption can be saved.

Here, the received data may include at least one of voltage data generated based on a motion of the sensing device 200, acceleration data that sensed the motion of the sensing device 200, or humidity data that sensed humidity of the ambient environment of the sensing device 200. That is, the sensing device 200 may transmit at least one of voltage data, acceleration data, or humidity data by the broadcasting method.

For example, in case an energy generation module 221 (refer to FIG. 10) using energy harvesting is provided in the sensing device 200, when a motion of the sensing device 200 occurs, the kinetic energy according to the motion may be converted into electric energy. Here, the sensing device 200 may sense a voltage for the electric energy, and obtain voltage data. Also, the sensing device 200 may transmit the identification information and the voltage data of the sensing device 200 together by the broadcasting method.

For example, in case an acceleration sensor 215 (refer to FIG. 10) is provided in the sensing device 200, when a motion of the sensing device 200 occurs, the sensing device 200 may sense acceleration (or change of the location, etc.) according to the motion, and obtain acceleration data. Also, the sensing device 200 may transmit the identification information and the acceleration data of the sensing device 200 together by the broadcasting method.

As another example, in case the sensor 210 such as the humidity sensor 211 (refer to FIG. 10) and the energy generation module 221 are provided in the sensing device 200, the energy generation module 221 may provide electric energy to the sensor 210 whenever kinetic energy is converted into electric energy as a motion of the sensing device 200 occurred. That is, the humidity sensor 211 may sense the humidity of the ambient environment whenever a motion of the sensing device 200 occurs, and obtain humidity data. Also, the sensing device 200 may transmit the identification information and the humidity data of the sensing device 200 together by the broadcasting method. Meanwhile, humidity is a unit indicating the amount or the ratio of vapor included in the air, and is a concept including various indices such as relative humidity that divided pressure of vapor in a specific temperature by pressure of saturated vapor in a specific temperature, or absolute humidity indicating the amount of vapor included in a unit volume, etc. As above, humidity may indicate the degree of moisture included in the air.

As described above, all of voltage data, acceleration data, and humidity data may be obtained based on a motion of the sensing device 200. For example, if a case wherein the drum 110 rotates in the preset pattern as in (a) of FIG. 6 is assumed, the voltage data, the acceleration data, and the humidity data, etc. obtained based on the motion of the sensing device 200 may be indicated as data having values (voltage, acceleration, humidity, etc.) according to time as in the graph in (b) of FIG. 6.

Afterwards, the processor 150 may identify a sensing device 200 having a motion corresponding to the preset pattern among the at least one sensing device 200 based on the received data in operation S440.

Here, the processor 150 may regard a sensing device 200 having a motion corresponding to the rotation of the drum 110 as a sensing device introduced (or located) inside the drum 110. This used the fact that, when the drum 110 rotates according to the preset pattern, a motion also occurs in the sensing device 200 introduced inside the drum 110 because of this.

Here, the processor 150 may identify a sensing device 200 that transmitted data including data matched to the rotating section and data matched to the holding section among the received data as a sensing device 200 having a motion corresponding to the preset pattern.

As an example, the processor 150 may identify whether the data received from the at least one sensing device 200 is matched to each of a rotating section and a holding section included in the preset pattern. For example, if the value of the received data (e.g.: (b) of FIG. 6) is greater than or equal to a preset value, the processor 150 may adjust the value to a value corresponding to the control signal $S_{on}$ (e.g.: $V_{on}$), and if the value of the data is smaller than the preset value, the processor 150 may adjust the value to a value corresponding to the control signal $S_{off}$ (e.g.: $V_{off}$). Here, the data may be divided into a $V_{on}$ section and a $V_{off}$ section through the adjusted values. Then, the processor 150 may compare the lengths of the time of the $V_{on}$ section and the time of the rotating section, and calculate a score according to the degree that the lengths of the times of the compared sections coincide, and if the calculated score is greater than or equal to the preset value, the processor 150 may determine that the $V_{on}$ section of the data is matched to the rotating section. By such a method, the processor 150 may compare the lengths of the time of the $V_{off}$ section and the time of the holding section, and calculate a score according to the degree that the lengths of the times of the compared sections coincide, and if the calculated score is greater than or equal to the preset value, the processor 150 may determine that the $V_{off}$ section of the data is matched to the holding section.

As an example, the processor 150 may determine whether a symbol of the changed amount (or the size of the changed amount, etc.) of the data received from the at least one sensing device 200 is matched to each of the rotating section and the holding section included in the preset pattern. For example, the processor 150 may differentiate the value of the data, and calculate symbols (e.g.: (c) of FIG. 6) regarding the changed amount of the data for each time. Here, the data may be divided into (+) sections and (−) sections according to the symbols. The processor 150 may compare the starting time of the (+) section and the starting time of the rotating section, and calculate a score according to the degree that the starting times (or the delayed times) of the compared sections coincide, and if the calculated score is greater than or equal to a preset value, the processor 150 may determine that the (+) section of the data is matched to the rotating section. By such a method, the processor 150 may compare the starting time of the (−) section and the starting time of the holding section, and calculate a score according to the degree that the starting times (or the delayed times) of the compared sections coincide, and if the calculated score is greater than or equal to the preset value, the processor 150 may determine that the (−) section of the data is matched to the holding section.

Meanwhile, the aforementioned embodiment is merely an example, and the disclosure is not limited thereto, but can be modified in various ways.

As an example, if a sensing device 200 having a motion corresponding to the preset pattern is identified among the at least one sensing device 200 in operation S440, the processor 150 may store identification information received from the identified sensing device 200. Prior to this, the processor 150 may receive identification information from the at least one sensing device 200 through the communication interface 140. In this case, the identification information is unique information for identifying a specific sensing device 200 from other sensing devices, and it may be stored in the memory 190 (refer to FIG. 8). Accordingly, the processor 150 may use humidity data of the sensing device 200 matched to the stored identification information.

Then, the processor 150 may control the driving unit 120 and the heater 130 to perform the drying cycle based on the humidity data received from the identified sensing device 200 through the communication interface 140 in operation S450. That is, the processor 150 may perform the drying cycle while ignoring (or filtering) humidity data received from sensing devices other than the identified sensing device 200.

Specifically, if a user command for a drying cycle is received, the processor 150 may control the driving unit 120 to rotate the drum 110 in the preset pattern, and after the drum 110 rotated in the preset pattern, the processor 150 may control the driving unit 120 and the heater 130 to perform the drying cycle according to the user command.

Here, the drying cycle may refer to rotating the drum 110, and heating the air supplied to the interior of the drum 110 through the heater 130. Specifically, the processor 150 may control the driving unit 120 to rotate the drum 110 and control the heater 130 to heat the air supplied to the interior of the drum 110 based on the humidity data received from the identified sensing device 200 through the communication interface 140. Also, the processor 150 may control the rotating speed of the drum 110 and the rotating direction of the drum 110 through control of the driving unit 120 according to the humidity value of the humidity data received from the identified sensing device 200 (or the time that the drying cycle was performed, etc.). Also, the processor 150 may control the temperature of the air supplied to the interior of the drum 110 through control of the heater 130 according to the humidity value of the humidity data received from the identified sensing device 200 (or the time that the drying cycle was performed, etc.). For this, it may be set in advance such that at least one of the rotating speed of the drum 110, the rotating direction of the drum 110, or the temperature of the air (or the heating degree of the heater 130, etc.) is changed according to the humidity value (or the time that the drying cycle was performed, etc.), and stored in the drying device 100.

As an example, in case the identification information of the identified sensing device 200 is stored, when the humidity data sensed at the at least one sensing device 200 and the identification information of the at least one sensing device 200 are received through the communication interface 140, the processor 150 may identify the humidity data received from the identified sensing device 200 among the received humidity data based on the stored identification information. In this case, the processor 150 may control the driving unit 120 and the heater 130 to perform the drying cycle based on the identified humidity data.

Then, the processor 150 may determine whether the humidity value of the humidity data received from the identified sensing device 200 is smaller than a reference value $H_{Th}$ in operation S460. Here, if the humidity value of the humidity data received from the identified sensing device 200 is greater than or equal to the reference value $H_{Th}$ in operation S460, N, the processor 150 may control the driving unit 120 and the heater 130 to continuously perform the drying cycle.

Also, if the humidity value of the humidity data received from the identified sensing device 200 is smaller than the reference value $H_{Th}$ in operation S460, Y, the processor 150 may determine that the drying cycle has been completed. That is, if the humidity value of the humidity data received from the identified sensing device 200 is smaller than the reference value $H_{Th}$ in operation S460, Y, the processor 150 may control the driving unit 120 and the heater 130 to stop the drying cycle.

The humidity and the reference value $H_{Th}$ inside the drum 110 will be described in detail with reference to FIG. 7.

The initial time indicates the humidity inside the drum 110 in case wet clothes were introduced into the interior of the drum 110, and during the initial time, if heated air is supplied into the interior of the drum 110 as a drying cycle proceeds, moisture contained in the clothes may be vaporized together with rise of the temperature inside the drum 110. Also, the air having high humidity may move through the duct 10D, and the moisture may be removed through condensation at the heat pump 131. During the initial time, the degree that the moisture (or the vapor) in the air is vaporized is greater compared to the degree that the moisture in the air is removed, and thus humidity may gradually increase. During the middle time afterwards, the degree that the moisture is vaporized and the degree that the moisture is removed are similar to each other, and thus the humidity main maintain a specific level. During the ending time afterwards, most moisture contained in the clothes are vaporized, and the degree that the moisture (or the vapor) in the air is vaporized is smaller than the degree that the moisture in the air is removed, and thus the humidity may gradually decrease. Afterwards, when the drying of the clothes is completed, the humidity may reach a specific level.

As described above, in the drying device 100, a reference value $H_{Th}$ for determining whether drying of clothes has been completed may be stored in advance. For example, the reference value $H_{Th}$ may be stored in advance in the memory 190 of the drying device 100. The value of the reference value $H_{Th}$ may be set through experiments, statistics, simulation, etc.

Meanwhile, for preventing a phenomenon wherein it is determined that drying has been completed during the initial time having lower humidity than the reference value $H_{Th}$, the processor 150 may determine whether the drying cycle has been completed after a preset time passed after the drying cycle started, or determine whether the drying cycle has been completed after the humidity value started to decrease after reaching the peak point. Alternatively, in the case of maintaining the humidity satisfying a value smaller than the reference value $H_{Th}$ during a preset time, the processor 150 may determine that the drying cycle has been completed.

Meanwhile, it is also possible that the processor 150 adjusts the reference value $H_{Th}$ used in determining completion of the drying cycle differently, according to the load amount (or the weight) of the clothes containing moisture. For this, in the memory 190, information on the reference value $H_{Th}$ matched for each load amount may be stored in advance. Also, the processor 150 may determine the load amount of the clothes introduced into the drum 110. As above, the operation of determining the load amount of clothes may be performed in the initial stage of the drying cycle or before the start of the drying cycle.

As an example, the operation of determining the load amount of clothes may be combined to the operation S420. That is, if a user command for a drying cycle is received, the processor 150 may control the driving unit 120 to rotate the drum 110 in the preset pattern, and determine the load amount of the clothes. For example, the processor 150 may control the driving unit 120 to transmit a driving force (e.g.: torque) in a specific size to the drum 110. In this case, the load amount (or the weight) of the clothes accommodated inside the drum 110 may be calculated based on a value of measuring the rotating degree (or the rotating speed, etc.) of the drum 110 and the weight of the drum 110 (or the inertia momentum, etc.).

Meanwhile, in case a sensing device 200 having a motion corresponding to the preset pattern is not identified after a user command for a drying cycle was received, the processor 150 according to an embodiment of the disclosure may control the driving unit 120 and the heater 130 to perform the drying cycle based on the humidity data obtained from the sensor 180 provided in the drying device 100 in operation S455. Here, the case wherein a sensing device 200 having a motion corresponding to the preset pattern is not identified may include a case wherein data received from at least one sensing device 200 does not exist in the drying device 100 in operation S430, N, or a case wherein data was received from at least one sensing device 200, but the received data is not matched to the preset pattern.

In this case, the processor 150 may perform the drying cycle based on the humidity data obtained from the sensor 180 provided in the drying device 100 in operation S455, and in case the humidity value of the humidity data obtained from the sensor 180 provided in the drying device 100 is lower than the reference value $H_{Th}$ in operation S465, Y, the processor 150 may determine that the drying cycle has been completed, and control the driving unit 120 and the heater 130 to stop the drying process in operation S470.

FIG. 8 is a block diagram for illustrating additional components of a drying device according to an embodiment of the disclosure.

Referring to FIG. 8, the drying device 100 according to an embodiment of the disclosure may further include at least one of the input interface 160, the output interface 170, the sensor 180, or the memory 190 other than the drum 110, the driving unit 120, the heater 130, the communication interface 140, and the processor 150. Here, explanation regarding the overlapping contents will be omitted.

The drum 110 may accommodate clothes in its interior, and the drum 110 may be arranged to be rotatable inside the drying device 100.

The driving unit 120 may transmit a driving force to the drum 110 under control by the processor 150. For this, the driving unit 120 may include a motor 125. The motor 125 may refer to a motor converting energy (e.g.: a voltage, etc.) applied from the outside into power energy. For this, the motor 125 may include a stator (not shown) and a rotor (not shown). In the stator, a plurality of wound coils and internal resistance may be provided. In the rotor, a plurality of magnets generating electromagnetic interaction with the coils may be provided. The rotor may rotate by the electromagnetic interaction between the coils and the magnets. As above, the motor 125 may generate a driving force (e.g.: a rotating force), and the driving force generated from the motor 125 may be transmitted to the drum 110. In this case, the drum 110 may rotate by the driving force transmitted from the motor 125.

The heater 130 may heat the air supplied to the drum 110 according to a control signal of the processor 150. The heater 130 may include at least one of the heat pump 131 or the electric heater 135. The heat pump 131 may supply the heated air to the interior of the drum 110, and remove humidity of the humid air, and the electric heater 135 (refer to FIG. 8) may directly heat the air by converting electricity into heat.

The communication interface 140 may perform communication with the sensing device 200. For this, the communication interface 140 may include at least one of a Wi-Fi module 141, a Bluetooth module 143, or other communication modules 145. Each module may include a circuit and an antenna for performing communication according to Wi-Fi, Bluetooth, or Bluetooth Low Energy (BLE), or other wireless communication methods. However, this is merely an example, and the communication interface 140 may use various communication methods such as Near Field Communication (NFC), infrared Data Association (IrDA), Radio Frequency Identification (RFID), ultra-wideband (UWB), Wi-Fi Direct, Z-wave, Zigbee, 4LoWPAN, GPRS, Weightless, Digital Living Network Alliance (DLNA), ANT+, Digital Enhanced Cordless Telecommunications (DECT), wireless local area network (WLAN), Global System for Mobile communications (GSM), Universal Mobile Telecommunication System (UMTS), Wireless Broadband (WiBRO), and the like.

The processor 150 may control the overall operations of the drying device 100, or each component included in the drying device 100. For this, the processor 150 may be electronically connected with each component of the drying device 100. Specifically, the processor 150 may read and interpret at least one instruction and determine a sequence for data processing, and transmit a control signal controlling the operations of other components. Here, the at least one instruction may be stored in the memory (not shown) provided inside the processor 150, or stored in the memory 190 (refer to FIG. 8) provided in the drying device 100. Accordingly, each component of the drying device 100 may operate according to control by the processor 150.

Meanwhile, the processor 150 may consist of one or a plurality of processors, and the processor 150 may be implemented as a generic-purpose processor such as a central processing unit (CPU), an application processor (AP), etc., a graphic-dedicated processor such as a graphic processing unit (GPU), a vision processing unit (VPU), etc., or an artificial intelligence-dedicated processor such as a neural processing unit (NPU), etc. Meanwhile, a GPU may be implemented as a separate device from the processor 150. Also, a CPU and a GPU may perform the operations according to the disclosure in association. Here, the GPU may be implemented as a structure having several hundreds or thousands of cores specialized for a parallel processing method of processing several commands or data such as images simultaneously, and the CPU may be implemented as a structure having a few cores specialized for a series processing method of processing commands or data in the order that they are input.

The input interface 160 may receive various user inputs or user commands. The input interface 160 may include, for example, at least one of a button 161, a touch panel 165, or a microphone (not shown). The button 161 may include, for example, a physical button, a dial, a jog shuttle, or a keypad. The touch panel 165 may use, for example, at least one method among a capacitive method, a decompressive method, an infrared method, or an ultrasonic method, and for this, the touch panel 165 may include a control circuit. The touch panel 165 may further include a tactile layer, and provide a tactile response to a user. The microphone may directly receive a user's voice, and obtain an audio signal by converting the user's voice which is an analog signal into a digital signal by a digital converter (not shown).

The output interface 170 may include at least one of a display 171 or a speaker 175. Here, the display 171 is a device outputting information into a visual form (e.g.: characters, images, etc.). The display 171 may display an image frame in all or a part of pixel areas. A pixel area may refer to an area occupied by a pixel which is a minimum unit of an image. At least a part of the display 171 may be implemented in a form of a flexible display. The flexible display may be characterized in that it can be bent or curved without damage through a substrate which is thin and flexible like paper, and can be restored. The speaker 175 is a device outputting information into an auditory form (e.g.: a voice). The speaker 175 may output not only various kinds of audio data for which various processing works such as decoding or amplification, or noise filtering have been performed by an audio processor (not shown), but also various kinds of notification sounds or voice messages directly as sounds.

The sensor 180 may refer to a device that detects the amount or change of various physical signals (e.g.: the temperature, light, sound, chemical substance, electricity, magnetic property, pressure, etc.). Here, a detected signal may be converted into data that can be interpreted by the processor 150. The sensor 180 may transmit the sensed data to the processor 150, or store the sensed data in the memory 190 or an external device.

The sensor 180 may be implemented as various sensors such as a temperature sensor, a humidity sensor, a hall sensor, a load sensor, etc. The temperature sensor may detect the temperature of a target or the temperature of the interior environment of the drum 110. Here, the temperature sensor may be implemented as a thermistor using the property that the resistance of a substance changes according to the temperature, or an infrared camera, etc. The humidity sensor may obtain humidity data by sensing vapor (or moisture) in the air. The humidity sensor may obtain humidity data through various methods such as a method of using the property that the resistance (or the dielectric rate, etc.) of a substance changes according to a color change by a chemical reaction with vapor in the air, and the humidity, etc. The hall sensor may be arranged per specific location or specific angle interval of the motor 125. In this case, the hall sensor 125 may output location information of the rotor according to the rotation of the rotor as an on or off signal, and detect the rotating direction, the rotating speed co, and the rotating angle θ based on the signal of the rotor. The load sensor may detect the size (the load amount) of the load applied on the motor 125 while rotating the drum 110 through the driving force of the motor 125.

The memory 190 is a component wherein various kinds of information (or data) can be stored. For example, the memory 190 may store information in an electronic form or a magnetic form.

Specifically, in the memory 190, at least one instruction, a module, or data necessary for the operations of the drying device 100 or the processor 150 may be stored. Here, the instruction is a unit instructing the operation of the processor 150, and it may have been drafted in a machine language that can be understood by the processor 150. The module may be a set of instructions in subordinate units constituting a software program (or an operating system, an application, a dynamic library, or a runtime library, etc.), but this is merely an example, and the module may be the program itself. The data may be materials in bit or byte units that can be processed by the processor 150 to indicate information such as characters, numbers, sounds, images, etc.

Meanwhile, the method for the drying device 100 according to an embodiment of the disclosure to recognize the sensing device 200 introduced into the interior of the drum 110 without a paring process can be modified in various ways.

As an example, if a user command for a drying cycle is received through the input interface 160, the processor 150 may wait during a preset standby time (e.g.: N seconds, N is a value exceeding 0) from the time point when the user command was received. In this case, the processor 150 may control the output interface 170 to output a message such as "Please shake the sensor ball," etc. For example, a message such as "Please shake the sensor ball," etc. may be output through the display 171, or the message may be output as a voice through the speaker 175. Afterwards, when the user shakes the sensing device 200, the sensing device 200 may transmit the identification information and the sensing data (the humidity, etc.) by a broadcasting method based on the motion of the sensing device 200. Here, in the sensing device 200, electric energy may be generated through energy harvesting based on the motion of the sensing device 200.

Then, if the identification information of the sensing device 200 is received from the at least one sensing device 200 through the communication interface 140 during the standby time, the processor 150 may store the received identification in the memory 190. In this case, the processor 150 may receive humidity data from the sensing device 200 that transmitted the stored identification information through the communication interface 140.

Then, the processor 150 may control the driving unit 120 and the heater 130 to perform the drying cycle based on the humidity data received from the sensing device 200 that transmitted the stored identification information. That is, the processor 150 may ignore (or filter) humidity data received from sensing devices other than the sensing device 200 that transmitted the stored identification information.

As another example, after a user command for a drying cycle was received through the input interface 160, when identification information is received from at least one sensing device 200 through the communication interface 140, the processor 150 may determine whether the received identification information coincides with one of identification information stored in the memory 190 in advance.

Then, in case the received identification information of the sensing device 200 does not coincide with one of the prestored identification information (i.e., in case the received identification information is new), the processor 150 may control the driving unit 120 to rotate the drum 110 in a preset pattern. Afterwards, when data generated based on a motion of the sensing device 200 is received from the sensing device 200 through the communication interface 140, the processor 150 may identify whether the sensing device is a sensing device having a motion corresponding to the preset pattern based on the received data. Then, in case the sensing device 200 corresponding to the received identification information was identified as a sensing device having a motion corresponding to the preset pattern, the processor 150 may control the driving unit 120 and the heater 130 to perform the drying cycle based on the humidity data received from the identified sensing device through the communication interface 140.

Unlike the above, in case the received identification information of the sensing device 200 coincides with one of the prestored identification information (i.e., in case the received identification information was pre-registered), the processor 150 may control the driving unit 120 and the heater 130 to perform the drying cycle based on the humidity data received from the sensing device 200 that transmitted the stored identification information.

As another example, after a user command for a drying cycle was received through the input interface 160, the processor 150 may receive a wireless signal including sensing data (e.g.: humidity, etc.) from at least one sensing device 200 through the communication interface 140.

Then, the processor 150 may identify sensing data (e.g.: humidity, etc.) included in a wireless signal wherein the size of the received wireless signal (Received Signal Strength Identification; RSSI) is greater than or equal to a preset value. Alternatively, the processor 150 may identify sensing data included in a wireless signal wherein the RSSI is the biggest. Here, the processor 150 may identify a sensing device that transmitted a wireless signal wherein the RSSI is greater than or equal to the preset value (or the biggest).

Then, the processor 150 may control the driving unit 120 and the heater 130 to perform the drying cycle based on the identified sensing data.

Figure 9A:
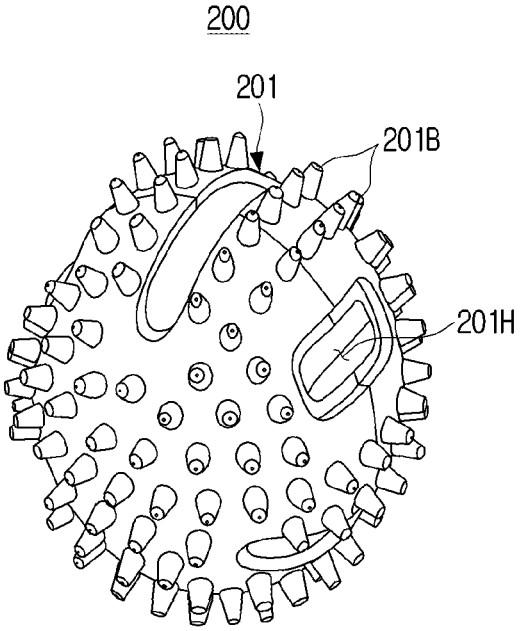
FIG. 9A is a diagram for illustrating a sensing device according to an embodiment of the disclosure.
Figure 9B:
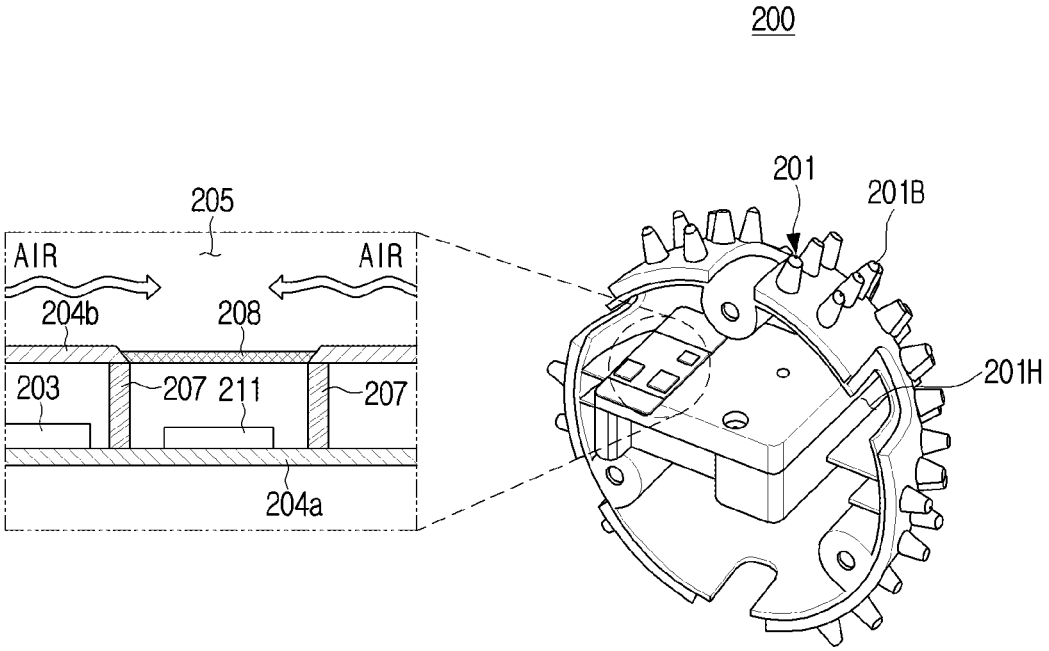
FIG. 9B is a diagram for illustrating a sensing device according to an embodiment of the disclosure.

FIG. 9A is a diagram for illustrating a sensing device according to an embodiment of the disclosure, and FIG. 9B is a diagram for illustrating a sensing device according to an embodiment of the disclosure.

Referring to FIG. 9A and FIG. 9B, the sensing device 200 includes a main body 201 forming the exterior, and the sensor 210 (refer to FIG. 10), a power part 220 (refer to FIG. 10), a communication interface 230 (refer to FIG. 10), and a processor 240 (refer to FIG. 10) that will be described below may be arranged inside the main body 201.

The sensing device 200 is a device that is physically independent from components such as the drum 110, etc. of the drying device 100. The sensing device 200 may be introduced into the interior of the drum 110 as in FIG. 5, and may make free movements inside the drum 110 according to the rotation of the drum 110. For example, the sensing device 200 may make movements such as rotation, fall, tumbling, etc. together with clothes inside the drum 110 according to the rotation of the drum 110. For this, the sensing device 200 may be formed in the form of a sphere, but this is merely an example, and the sensing device 200 can be any size or form that can move freely inside the drum 110 by the rotation of the drum 110, and it may be formed in various shapes such as a polyhedron like a cuboid, a cylindrical U shape, or a star shape, etc. other than a sphere.

On the main body 201, at least one opening 201H may be formed. Through the opening 201H, air inside the drum 110 may be introduced into the interior of the main body 201, and the sensor 210 provided inside the main body 201 may obtain sensing data by sensing the humidity (or the temperature) of the introduced air. Alternatively, a part of the sensor 210 may be exposed through the opening 203, and measure the humidity (or the temperature) inside the drum 110.

On the external wall of the main body 201, at least one projection part 201B may be formed. The projection part 201B may perform a function of assisting such that the free movement of the sensing device 200 according to the rotation of the drum 110 can become smoother. Also, on the projection part 201B, a sensor 210 may be arranged. For example, an opening may be formed on the projection part 201B, and on the projection part 201B, a conductive material that contacts air introduced through the opening and acts as an electrode of the sensor 210 may be arranged. In this case, the projection part 201B may increase the area that the sensor 210 contacts the air.

The sensor 210 may include a humidity sensor 211. The humidity sensor 211 may measure the humidity inside the drum 110 by adopting one of various methods of measuring humidity. For example, the humidity sensor 211 may measure humidity according to an electronic resistance method, or measure humidity according to an electronic capacity method. A conventional drying device had a structure wherein a humidity sensor was installed on the drying device, and due to the characteristic that the drum continuously rotated, the humidity sensor connected with an external power could be installed in limited locations, and in general, the humidity sensor was installed on the front surface or the rear surface of the drum. In such a situation, a case wherein clothes rotated inside the drum and did not contact the humidity sensor occurred according to the weight or the fiber characteristic of the clothes, and this became a factor for reducing accuracy in measuring humidity.

The humidity sensor 211 of the sensing device 200 according to an embodiment may measure humidity by a method of directly contacting clothes, or measure humidity by a method of measuring moisture existing in the air inside the drum 110.

As the sensing device 200 freely moves inside the drum 110 together with clothes (laundry), contact with the clothes inside the drum 110 or the air inside the drum 110 is easy, and by virtue of this, measurement of humidity data of the humidity sensor 211 can be improved.

Referring to FIG. 9B, air inside the drum 110 may be introduced into the interior of the main body 201 through the opening 201H formed on the main body 201. As described above, the sensing device 200 moves while making movements such as rotation, free fall, tumbling, etc. by the rotation of the drum 110, and thus air can be introduced into the interior of the sensing device 200 through the opening 201H even if there is no separate blowing device.

The space inside the main body 201 may be divided (or comparted) by a first plate 204*a* and a second plate 204*b*.

For example, in the space between the first plate 204*a* and the second plate 204*b*, the humidity sensor 211 and a PCB circuit 203 connected thereto may be arranged. Here, although a detailed wiring structure is not illustrated in the drawing of FIG. 9B, the humidity sensor 211 may be connected with the PCB circuit 203 through wirings in various structures. On the second plate 204*b*, a hole corresponding to the humidity sensor 211 may be formed. Here, the area wherein the hole of the second plate 204*b* is formed may mean the upper area of the humidity sensor 211, or an area facing the humidity sensor 211. The space between the second plate 204*b* and the inner wall of the main body 201 may perform a role of a flow channel through which air flows. The air inside the drum 110 may be introduced into the interior of the sensing device 200 through the opening 201H, and the introduced air may contact the humidity sensor 211 through the hole formed on the second plate 204*b*. The humidity sensor 211 may measure humidity of the air introduced through the hole formed on the second plate 204*b*.

As an example, it is also possible to protect the humidity sensor 211 by arranging a moisture-permeable filter 208 on the hole formed on the second plate 204*b*. The moisture-permeable filter 208 may protect the humidity sensor 211 by allowing only air (or moisture) smaller than a specific diameter to pass through, and filtering foreign substances such as water drops and dust, etc. greater than or equal to the specific diameter.

As an example, it is also possible to surround the humidity sensor 211 with a heat blocking wall 207. Here, by arranging the PCB circuit 203 outside the heat blocking wall 207, a phenomenon that the PCB circuit 203 is damaged or malfunctions by heat included in the air that passed through the moisture-permeable filter 208 can be prevented. As another example, it is also obviously possible to surround the PCB circuit 203 with the heat blocking wall.

Meanwhile, in case the humidity sensor 211 measures humidity by directly contacting clothes (laundry), it is also possible to expose the electrode of the humidity sensor 211 through the opening 201H, or apply a conductive material on the projection part 201B formed on the external wall of the main body 201, and make the projection part 201B function as the electrode of the humidity sensor 211.

Meanwhile, the aforementioned explanation is merely an example that can be applied to the sensing device 200. Accordingly, embodiments of the sensing device 200 are not limited to the aforementioned structure.

Figure 10:
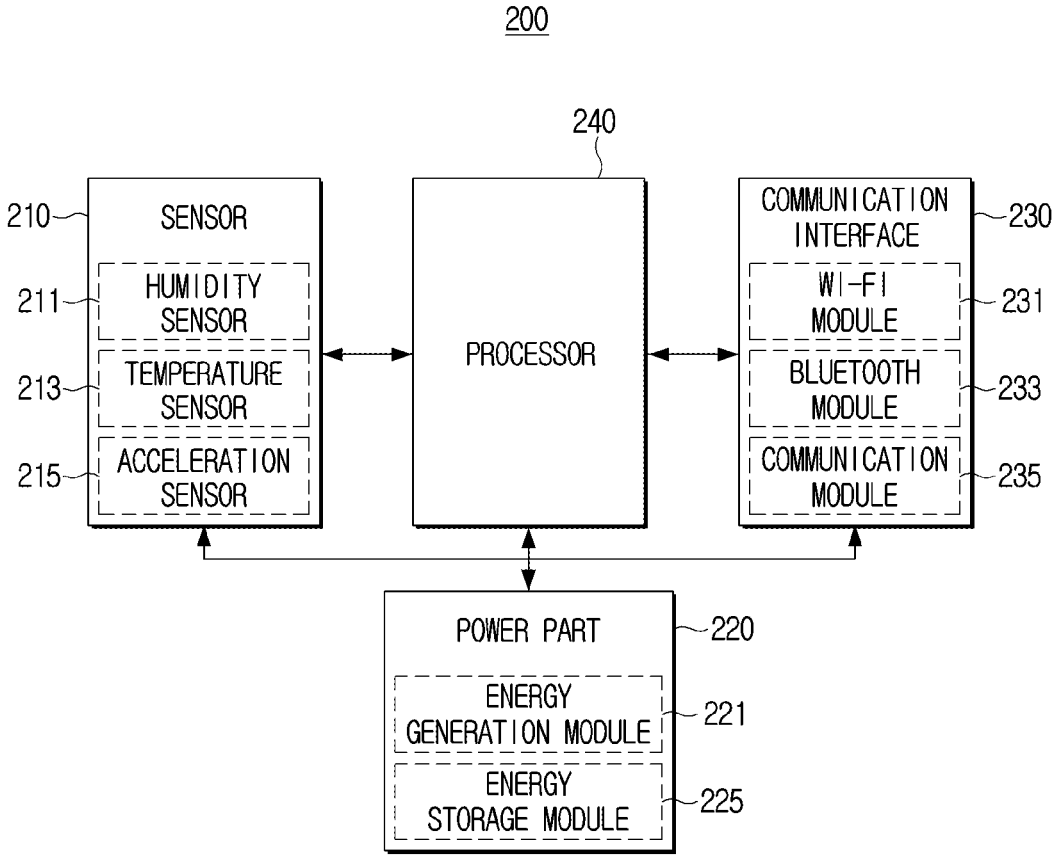
FIG. 10 is a block diagram for illustrating a configuration of a sensing device according to an embodiment of the disclosure.

FIG. 10 is a block diagram for illustrating a configuration of a sensing device according to an embodiment of the disclosure.

Referring to FIG. 10, the sensing device 200 may include a sensor 210, a power part 220, a communication interface 230, and a processor 240.

The sensor 210 may operate by power supplied from the power part 220. The sensor 210 may include a humidity sensor 211. Also, the sensor 210 may further include at least one of a temperature sensor 213 or an acceleration sensor 215.

The humidity sensor 211 may obtain humidity data by sensing vapor (or moisture) in the air. The humidity sensor 211 may obtain humidity data through various methods such as a method of using the property that the resistance (or the dielectric rate, etc.) of a substance changes according to a color change by a chemical reaction with vapor in the air, and the humidity, etc.

The temperature sensor 213 may detect the temperature of a target or the temperature of the ambient environment of the sensing device 200 (e.g.: the interior environment of the drum 110 in case the sensing device 200 was introduced into the interior of the drum 110). Here, the temperature sensor 213 may be implemented as a thermistor using the property that the resistance of a substance changes according to the temperature, or an infrared camera, etc.

Meanwhile, the processor 240 may operate the relative humidity (e.g.: the ratio of the amount of vapor and the amount of the saturated vapor at the current temperature, etc.) inside the drum 110 by using the humidity data obtained by the humidity sensor 211 and the temperature data obtained by the temperature sensor 212. Meanwhile, such an operation can also be performed at the drying device 100. That is, when the humidity data obtained by the humidity sensor 211 and the temperature data obtained by the temperature sensor 212 are received from the sensing device 200 through the communication interface 140, the processor 150 of the drying device 100 may operate the relative humidity inside the drum 110 by using the received data.

The acceleration sensor 215 may obtain acceleration data by measuring acceleration according to a motion of the sensing device 200. For this, the acceleration sensor 215 may be implemented as various methods such as an electrostatic capacity method, a piezo resistance method, a heat detection method, etc.

For example, in case the acceleration sensor 215 is implemented as an electrostatic capacity method, the acceleration sensor 215 may include a fixed electrode of which location is fixed and a movable electrode of which location can be changed through a spring. In a state wherein acceleration is not applied, the distance between the fixed electrode and the movable electrode is identical, but in a state wherein acceleration is applied, the movable electrode is displaced, and accordingly, change in the location relation with the fixed electrode occurs, and the capacity between the electrodes may be changed. Here, the acceleration sensor 215 may detect a voltage according to the change of the capacity, and calculate acceleration corresponding to the voltage.

The power part 220 may include at least one of an energy generation module 221 or an energy storage module 225. Meanwhile, according to an embodiment of the disclosure, the power part 220 may include both of the energy generation module 221 and the energy storage module 225. In this case, energy generated at the energy generation module 221 may be stored in the energy storage module 225.

As an example, the power part 220 may include an energy storage module 225 such as a battery (e.g.: a lithium ion battery, etc.). The sensing device 200 may perform an operation by using energy stored in the energy storage module 225 as power.

As an example, the power part 220 may include the energy generation module 221 generating energy by using energy harvesting. Here, the energy harvesting technology is a technology used in producing electric energy by collecting discarded energy. The energy generation module 221 may generate electric energy necessary for operating the sensing device 200 by using the energy harvesting technology to which at least one of an electromagnetic inductive method, a triboelectrification method, a piezoelectric method, or a thermal transfer method is applied. The sensing device 200 may perform an operation by using the energy generated at the energy generation module 221.

Specifically, the energy generation module 221 may generate electric energy by inducing electro magneticity by using kinetic energy generated as the sensing device 200 performs at least one movement among rotation, free fall, and tumbling inside the rotating drum 110, generating triboelectrification, or generating a piezoelectric effect. Alternatively, the energy generation module 221 may convert thermal energy included in the air in a high temperature inside the drum 110 into electric energy.

Meanwhile, while electric energy is being generated at the energy generation module 221, the energy generation module 221 may obtain voltage data (or current data, etc.) according to time. For this, a sensing circuit for detecting a voltage (or a current, etc.) may be connected to the energy generation module 221.

The energy generation module 221 according to an embodiment of the disclosure may generate energy through energy harvesting by an electromagnetic inductive method. A detailed content in this regard will be described with reference to FIG. 9C.

Figure 9C:
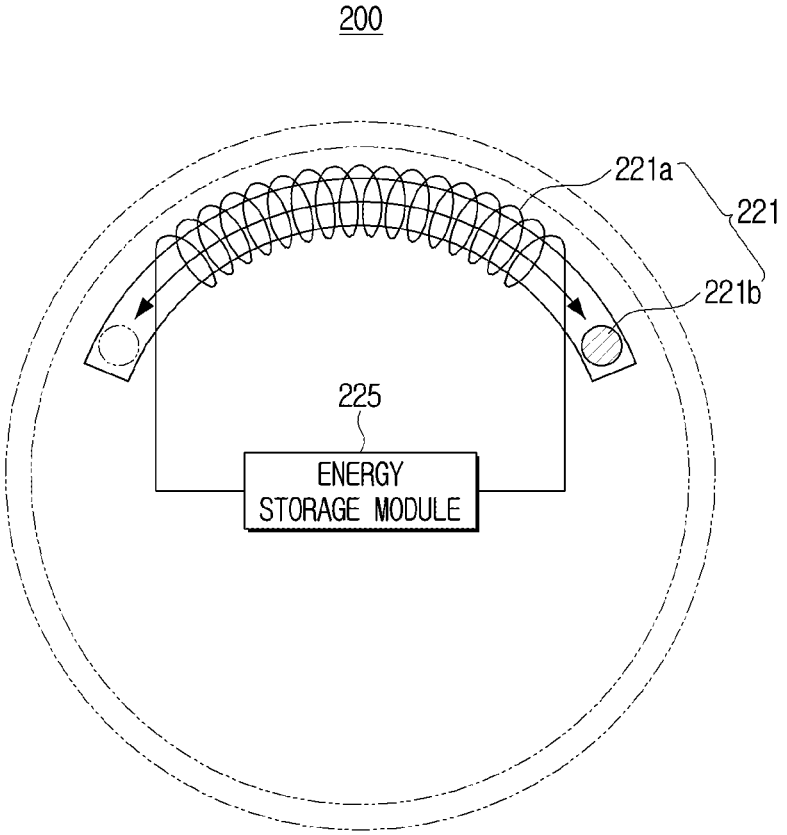
FIG. 9C is a diagram for illustrating a method for a sensing device to generate energy according to an embodiment of the disclosure.

FIG. 9C is a diagram for illustrating a method for a sensing device to generate energy according to an embodiment of the disclosure.

Referring to FIG. 9C, in case the energy generation module 221 generates electric energy by using an electromagnetic inductive method, the energy generation module 221 may include a coil 221*a* and a magnet 221*b*. The magnet 221*b* has a location and a shape that can move around the coil 221*a* by the rotation of the drum 110. As an example, the magnet 221*b* is in a spherical shape, and it may be provided in a location wherein it can move inside the coil 221*a*.

The sensing device 200 introduced into the drum 110 may make rotation, free fall, and tumbling movement by the rotation of the drum 120. In this case, the magnet 221*b* accommodated inside the sensing device 200 may move inside the coil 221*a* according to the movement of the sensing device 200. When the magnet 221*b* moves inside the coil 221*a*, an inductive current gets to flow in the coil 221*a* according to the principle of electromagnetic induction, and an inductive electromotive force may be generated on both ends of the coil 221*a*. Alternatively, it is also possible that the coil 221*a* moves while the magnet 221*b* is in a fixed state. The relative movements of the magnet 221*b* and the coil 221*a* may be as in the embodiment of FIG. 9C, and an inductive current may flow in the coil 221*a* according to the principle of electromagnetic induction, and accordingly, an inductive electromotive force may be generated on both ends of the coil 221*a*.

The inductive electromotive force generated at the energy generation module 221 may be stored in the energy storage module 225 connected with the energy generation module 221. The energy storage module 225 may consist of at least one device that can store energy such as a capacitor, etc.

As described above, the sensing device 200 may generate electric energy from the kinetic energy generated as it freely moves inside the drum 110 through an energy harvesting technology. Accordingly, the sensing device 200 may generate power by itself even though it is not supplied with power from the drying device 100. Accordingly, even if the sensing device 200 is not connected with the drying device 100 via wire or is not installed on the drying device 100, the sensing device 200 can measure humidity by using power that it generated by itself, and transmit data for the measured humidity to the drying device 100.

The communication interface 230 may include at least one of wireless communication modules such as a Bluetooth module 231, a Bluetooth module 233, a Wi-Fi module 235, etc. Meanwhile, the communication interface 230 just needs to transmit or receive data by various methods, and there is no specific limitation on the types of communication methods or communication modules applied to the communication interface 230. Regarding the communication interface 230, explanation regarding the communication interface 140 can be applied, and as detailed contents with respect to them overlap, explanation will be omitted.

The processor 240 may control the overall operations of the sensing device 200 or the components of the sensing device 200. For this, the processor 240 may be implemented as a micro controller unit (MCU). Also, as an example, the sensing device 200 may further include a memory wherein instructions or programs are stored. Also, in the memory, identification information indicating unique identifiers for identifying the sensing device 200 may be stored.

The processor 240 may control the sensor 210 to sense the ambient environment. Also, the processor 240 may adjust the sensing cycle of the sensor 210, and in this case, the sensor 210 may repeatedly perform an operation of sensing (or an operation of not sensing) the ambient environment according to the sensing cycle.

The processor 240 may control the communication interface 230 to transmit at least one of sensing data obtained at the sensor 210 or identification information of the sensing device 200. Here, the processor 240 may control the communication interface 230 to transmit at least one of the sensing data or the identification information of the sensing device 200 according to a broadcasting method. Also, the processor 240 may adjust the transmission cycle of the communication interface 230, and in this case, the communication interface 230 may repeatedly perform an operation of transmitting (or an operation of not transmitting) data according to the transmission cycle.

Figure 11:
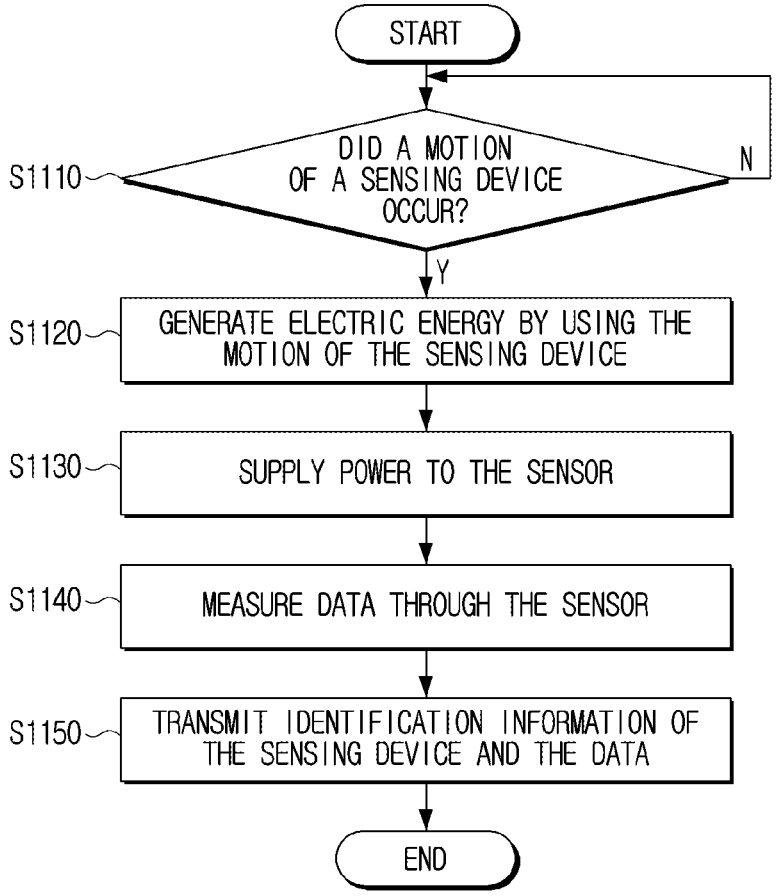
FIG. 11 is a diagram for illustrating an operation of a sensing device according to an embodiment of the disclosure.

FIG. 11 is a diagram for illustrating an operation of a sensing device according to an embodiment of the disclosure.

Referring to FIG. 11, when a motion of the sensing device 200 occurs in operation S1110, Y, the sensing device 200 may generate electric energy by using the motion of the sensing device 200 by the energy generation module 221 in operation S1120. Here, in case the sensing device 200 was introduced into the interior of the drum 110, the motion of the sensing device 200 may have occurred according to rotation of the drum 110.

Then, the sensing device 200 may provide the generated electric energy to the power of the sensor 210 in operation S1130. Also, the sensing device 200 may supply the generated electric energy to other components (e.g.: the processor 240, the communication interface 230, etc.) of the sensing device 200.

Then, when power is supplied to the sensor 210, the sensing device 200 may measure (or obtain) sensing data through the sensor 210 in operation S1130. Here, the sensing data may be at least one of voltage data (or current data), humidity data, temperature data, or acceleration data.

Then, the sensing device 200 may transmit the identification information of the sensing device 200 and the sensing data in operation S1140. Here, the transmitted data may be transmitted according to the broadcasting method.

As described above, the sensing device 200 according to an embodiment of the disclosure uses electric energy generated according to the rotation of the drum 110, and thus the sensing device 200 can obtain data for determining the drying degree of clothes more correctly without separate processes such as battery exchange, battery charging, etc. Also, even in a state wherein electric energy generated through energy harvesting is not sufficient, the sensing device 200 uses the broadcasting method in data transmission without performing a paring process, and thus unnecessary power consumption can be reduced.

In this case, the drying device 100 can identify the sensing device 200 introduced into the interior of the drum 110 correctly through the data obtained by the rotation of the drum 110 without a paring process.

Figure 12:
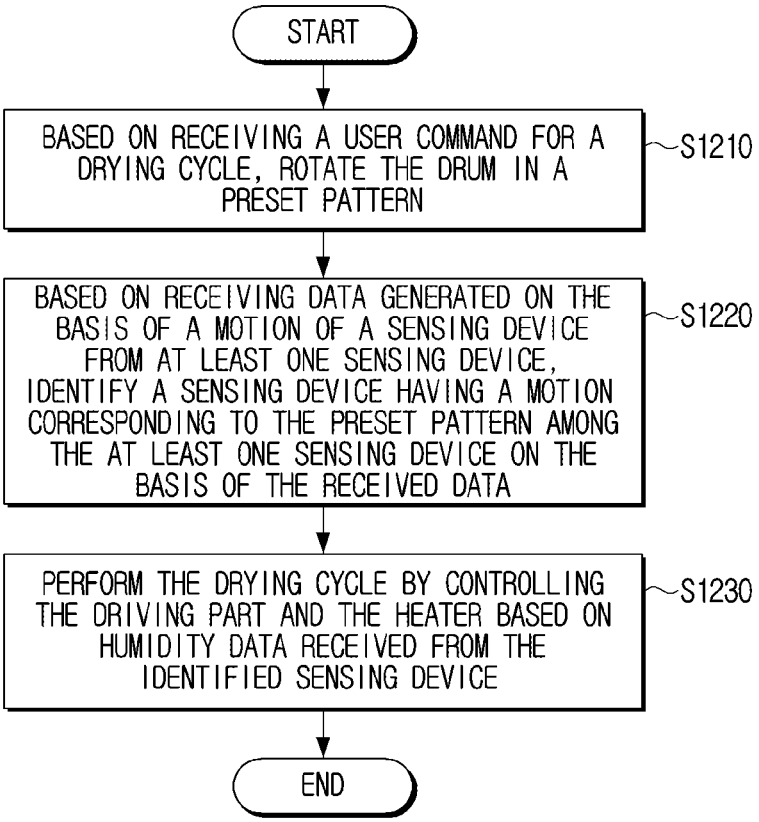
FIG. 12 is a diagram for illustrating a flow chart according to an embodiment of the disclosure.

FIG. 12 is a diagram for illustrating a flow chart according to an embodiment of the disclosure.

Referring to FIG. 12, if a user command for a drying cycle is received, the drum 110 may be rotated in a preset pattern in operation S1210. Here, the preset pattern may be a pattern that a rotating section wherein the drum 110 rotates during a preset first time and a holding section wherein the drum 110 stops during a preset second time are repeatedly performed.

Then, when data generated based on a motion of the sensing device 200 is received from at least one sensing device 200, a sensing device 200 having a motion corresponding to the preset pattern among the at least one sensing device 200 may be identified based on the received data in operation S1220.

Specifically, the data generated based on the motion of the sensing device 200 may be received from the at least one sensing device 200. Here, the received data may include at least one of voltage data generated based on the motion of the sensing device 200, acceleration data that sensed the motion of the sensing device 200, or humidity data that sensed humidity of the ambient environment of the sensing device 200. In this case, the identification information of the sensing device 200 may also be received together from the at least one sensing device 200.

Here, the data and the humidity data transmitted from the at least one sensing device 200 by a broadcasting method may be received. Here, the identification information of the sensing device 200 may also be transmitted by the broadcasting method, and received at the drying device 100. That is, the data or information received from the sensing device 200 may have been transmitted by the broadcasting method. Here, in the case of the broadcasting method, pairing that maintains a state wherein two devices communicating with each other share a specific communication channel is not required (i.e., paring of a receiver and a transmitter is not maintained during a communication process of data), and accordingly, there is an advantage that power consumption can be saved.

Afterwards, a sensing device 200 having a motion corresponding to the preset pattern may be identified among the at least one sensing device 200 based on the received data.

Here, in the identifying step, a sensing device 200 that transmitted data including data matched to the rotating section and data matched to the holding section among the received data may be identified as a sensing device 200 having a motion corresponding to the preset pattern.

Meanwhile, the control method according to an embodiment of the disclosure may include the step of receiving the data and identification information of the at least one sensing device 200 from the at least one sensing device 200. In this case, when a sensing device 200 having a motion corresponding to the preset pattern is identified among the at least one sensing device 200, identification information received from the identified sensing device 200 among the received identification information may be stored.

Then, the driving unit 120 and the heater 130 may be controlled to perform the drying cycle based on humidity data received from the identified sensing device 200 in operation S1230.

Here, in the controlling step, after the drum 110 rotated in the preset pattern, the driving unit 120 and the heater 130 may be controlled to perform the drying cycle according to the user command.

As an example, in case the identification information of the identified sensing device 200 is stored, when humidity data sensed at the at least one sensing device 200 and the identification information of the at least one sensing device 200 are received, humidity data received from the identified sensing device 200 among the received humidity data may be identified based on the stored identification information. Then, the driving unit 120 and the heater 130 may be controlled to perform the drying cycle based on the identified humidity data.

As an example, in the controlling step, if a humidity value of the humidity data received from the identified sensing device 200 is smaller than a reference value $H_{Th}$, the driving unit 120 and the heater 130 may be controlled to stop the drying cycle.

Meanwhile, the drying device 100 according to an embodiment of the disclosure may further include a sensor 180 sensing humidity for the interior environment of the drum 110.

In this case, the controlling step may further include the step of, in case a sensing device 200 having a motion corresponding to the preset pattern is not identified after a user command for the drying cycle was received, controlling the driving unit 120 and the heater 130 to perform the drying cycle based on the humidity data obtained from the sensor 180.

According to the various embodiments of the disclosure as described above, a drying device that identifies a sensing device and uses sensing data of the identified sensing device, and a method for controlling the same can be provided.

A drying device can perform a drying cycle by using more correct sensing data, and prevent contraction of clothes and damage to clothes. Also, a drying device can save power consumption of the drying device.

The various embodiments of the disclosure may be implemented as software including instructions stored in machine-readable storage media, which can be read by machines (e.g.: computers). The machines refer to devices that call instructions stored in a storage medium, and can operate according to the called instructions, and the devices may include an electronic device according to the aforementioned embodiments (e.g.: the drying device 100). In case an instruction is executed by a processor, the processor may perform a function corresponding to the instruction by itself, or by using other components under its control. An instruction may include a code that is generated or executed by a compiler or an interpreter. A storage medium that is readable by machines may be provided in the form of a non-transitory storage medium. Here, the term 'non-transitory' only means that a storage medium does not include signals, and is tangible, but does not indicate whether data is stored in the storage medium semi-permanently or temporarily.

Also, the method according to the various embodiments may be provided while being included in a computer program product. A computer program product refers to a product, and it can be traded between a seller and a buyer. A computer program product may be distributed in the form of a storage medium that is readable by machines (e.g.: a compact disc read only memory (CD-ROM)), or may be distributed on-line through an application store (e.g.: Play Store™). In the case of on-line distribution, at least a portion of a computer program product may be stored in a storage medium such as the server of the manufacturer, the server of the application store, and the memory of the relay server at least temporarily, or may be generated temporarily.

Further, each of the components (e.g.: a module or a program) according to the various embodiments may consist of a singular object or a plurality of objects. Also, among the aforementioned corresponding sub components, some sub components may be omitted, or other sub components may be further included in the various embodiments. Alternatively or additionally, some components (e.g.: a module or a program) may be integrated as an object, and perform functions performed by each of the components before integration identically or in a similar manner. In addition, operations performed by a module, a program, or other components according to the various embodiments may be executed sequentially, in parallel, repetitively, or heuristically. Or, at least some of the operations may be executed in a different order or omitted, or other operations may be added.

What is claimed is:

1. A drying device comprising:

a drum;

a driving unit;

a heater to heat air supplied to an interior of the drum;

a communication interface; and a processor configured to:

based on receiving a user command for a drying cycle, control the driving unit to rotate the drum in a preset pattern, based on receiving data generated on a basis of a motion of a sensing device from at least one sensing device through the communication interface, identify a sensing device having a motion corresponding to the preset pattern among the at least one sensing device, and control the driving unit and the heater to perform the drying cycle based on humidity data received from the identified sensing device through the communication interface.

2. The drying device of claim 1, wherein the preset pattern is a pattern having a rotating section in which the drum rotates during a preset first time, and a holding section in which the drum stops during a preset second time, repeatedly performed.

3. The drying device of claim 2, wherein the processor is configured to:

identify a sensing device that transmitted data including data matched to the rotating section and data matched to the holding section among the received data as the sensing device having the motion corresponding to the preset pattern.

4. The drying device of claim 1, wherein the processor is configured to:

receive identification information of the at least one sensing device from the at least one sensing device through the communication interface, and based on identifying the sensing device having the motion corresponding to the preset pattern among the at least one sensing device, store identification information received from the identified sensing device among the received identification information.

5. The drying device of claim 4, wherein the processor is configured to:

based on receiving humidity data sensed by the at least one sensing device and the identification information of the at least one sensing device through the communication interface, identify humidity data received from the identified sensing device among the received humidity data based on the stored identification information, and control the driving unit and the heater to perform the drying cycle based on the identified humidity data.

6. The drying device of claim 1, wherein the processor is configured to:

based on receiving a user command for the drying cycle, control the driving unit to rotate the drum in the preset pattern, and after the drum rotated in the preset pattern, control the driving unit and the heater to perform the drying cycle according to the user command.

7. The drying device of claim 1, wherein the processor is configured to:

receive humidity data from the identified sensing device through the communication interface, and based on a humidity value of the received humidity data being smaller than a reference value, control the driving unit and the heater to stop the drying cycle.

8. The drying device of claim 1, wherein the processor is configured to:

receive the data and the humidity data transmitted by a broadcasting method through the communication interface.

9. The drying device of claim 1, further comprising:

a sensor to sense humidity of an interior environment of the drum, wherein the processor is configured to:

based on the sensing device having the motion corresponding to the preset pattern not being identified after the user command for the drying cycle is received, control the driving unit and the heater to perform the drying cycle based on the humidity sensed by from the sensor.

10. The drying device of claim 1, wherein the received data comprises:

at least one of voltage data generated based on a motion of a sensing device, acceleration data that sensed the motion of the sensing device, and humidity data that sensed humidity of an ambient environment of the sensing device.

11. The drying device of claim 1, wherein the motion of the sensing device is motion of the sensing device while the sensing device is inside the drum.

12. A method for controlling a drying device comprising a driving unit to control a rotation of a drum and a heater to heat air supplied to an interior of the drum, the method comprising:

based on receiving a user command for a drying cycle, rotating the drum in a preset pattern;

based on receiving data generated on a basis of a motion of a sensing device from at least one sensing device, identifying a sensing device having a motion corresponding to the preset pattern among the at least one sensing device; and controlling the driving unit and the heater to perform the drying cycle based on humidity data received from the identified sensing device.

13. The controlling method of claim 12, wherein the preset pattern is a pattern having a rotating section in which the drum rotates during a preset first time, and a holding section in which the drum stops during a preset second time, repeatedly performed.

14. The controlling method of claim 13, wherein the identifying comprises:

identifying a sensing device that transmitted data including data matched to the rotating section and data matched to the holding section among the received data as the sensing device having the motion corresponding to the preset pattern.

15. The controlling method of claim 12, further comprising:

receiving identification information of the at least one sensing device from the at least one sensing device; and based on identifying the sensing device having the motion corresponding to the preset pattern among the at least one sensing device, storing identification information received from the identified sensing device among the received identification information.

16. The controlling method of claim 15, wherein the controlling further comprises:

based on receiving humidity data sensed by the at least one sensing device and the identification information of the at least one sensing device, identifying humidity data received from the identified sensing device among the received humidity data based on the stored identification information; and controlling the driving unit and the heater to perform the drying cycle based on the identified humidity data.

17. The controlling method of claim 12, wherein the motion of the sensing device is motion of the sensing device while the sensing device is inside the drum.

* * * * *